US010947967B1

(12) United States Patent
Surjaatmadja et al.

(10) Patent No.: US 10,947,967 B1
(45) Date of Patent: Mar. 16, 2021

(54) DISCHARGE VALVE DISABLER AND PRESSURE PULSE GENERATOR THEREFROM

(71) Applicant: Halliburton Energy Services, Inc., Houston, TX (US)

(72) Inventors: Jim Basuki Surjaatmadja, Duncan, OK (US); Robert Lee Pipkin, Marlow, OK (US); Timothy Holiman Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/815,245

(22) Filed: Mar. 11, 2020

(51) Int. Cl.

| | |
|---|---|
| ***F04B 49/24*** | (2006.01) |
| ***F04B 47/00*** | (2006.01) |
| ***F04B 49/22*** | (2006.01) |
| ***F04B 23/04*** | (2006.01) |
| *E21B 43/04* | (2006.01) |
| *E21B 43/26* | (2006.01) |
| *E21B 33/13* | (2006.01) |
| *F04B 53/10* | (2006.01) |

(52) U.S. Cl.
CPC ..... *F04B 49/246* (2013.01); *F04B 23/04* (2013.01); *F04B 47/00* (2013.01); *F04B 49/22* (2013.01); *F04B 49/225* (2013.01); *E21B 33/13* (2013.01); *E21B 43/04* (2013.01); *E21B 43/26* (2013.01); *F04B 49/243* (2013.01); *F04B 53/1097* (2013.01)

(58) Field of Classification Search
CPC ..... F04B 49/246; F04B 47/00; F04B 23/04; F04B 49/225; F04B 49/22; F04B 49/243; F04B 53/1022; F04B 53/1025; F04B 53/1097; E21B 43/26; E21B 43/04; E21B 33/13
See application file for complete search history.

(56) References Cited

U.S. PATENT DOCUMENTS

| | | | |
|---|---|---|---|
| 1,662,725 | A | 3/1928 | Toney, Jr. |
| 2,673,519 | A | 3/1954 | Halliburton |
| 2,678,006 | A | 5/1954 | Gray |
| 3,005,412 | A | 10/1961 | Camp |
| 3,229,640 | A | 1/1966 | Williams |
| 3,301,197 | A | 1/1967 | Dodson et al. |

(Continued)

FOREIGN PATENT DOCUMENTS

| | | | |
|---|---|---|---|
| CH | 257522 | A | 10/1948 |
| DE | 19808724 | A1 | 9/1998 |

(Continued)

OTHER PUBLICATIONS

Filing Receipt and Specification for U.S. Appl. No. 16/436,356, titled "Multi-Material Frac Valve Poppet," filed Jun. 10, 2019, 78 pages.

(Continued)

*Primary Examiner* — Dominick L Plakkoottam
(74) *Attorney, Agent, or Firm* — Conley Rose, P.C.; Rodney B. Carroll

(57) ABSTRACT

A discharge valve assembly configured to control fluid flow out of a chamber of a pump fluid end of a pump, wherein the discharge valve assembly comprises a controllable holding system (CHS), wherein the CHS is controllable to hold the discharge valve assembly in an open configuration.

20 Claims, 12 Drawing Sheets

(56) References Cited

U.S. PATENT DOCUMENTS

| | | | | |
|---|---|---|---|---|
| 3,380,247 | A | 4/1968 | Colmerauer | |
| 3,459,363 | A * | 8/1969 | Miller | F04B 49/243 417/446 |
| 3,887,305 | A | 6/1975 | Ito | |
| 4,007,663 | A | 2/1977 | Nagatomo et al. | |
| 4,021,152 | A | 5/1977 | Toyoda | |
| 4,470,545 | A | 9/1984 | Deckard et al. | |
| 4,478,561 | A | 10/1984 | Elliston | |
| 4,550,875 | A | 11/1985 | Teerman et al. | |
| 5,061,159 | A | 10/1991 | Pryor | |
| 5,601,344 | A | 2/1997 | Matsunaga et al. | |
| 5,797,452 | A | 8/1998 | Martin | |
| 8,360,751 | B2 | 1/2013 | Duncan | |
| 8,590,614 | B2 | 11/2013 | Surjaatmadja et al. | |
| 2007/0065302 | A1* | 3/2007 | Schmitz | F04B 49/24 417/298 |
| 2009/0120412 | A1 | 5/2009 | Tokuo et al. | |
| 2009/0246051 | A1 | 10/2009 | Kim | |
| 2010/0183448 | A1* | 7/2010 | Leugemors | F04B 49/22 417/53 |
| 2010/0270487 | A1* | 10/2010 | Ambrose | F16K 31/0665 251/129.15 |
| 2012/0018150 | A1 | 1/2012 | Shampine et al. | |
| 2012/0279721 | A1 | 11/2012 | Surjaatmadja et al. | |
| 2014/0127036 | A1 | 5/2014 | Buckley et al. | |
| 2014/0127058 | A1 | 5/2014 | Buckley et al. | |
| 2014/0127062 | A1 | 5/2014 | Buckley et al. | |
| 2014/0224498 | A1 | 8/2014 | Hay, II et al. | |
| 2014/0322050 | A1 | 10/2014 | Marette et al. | |
| 2016/0131131 | A1 | 5/2016 | Weaver et al. | |
| 2016/0281699 | A1 | 9/2016 | Gnessin et al. | |
| 2016/0319805 | A1 | 11/2016 | Dille | |
| 2017/0306905 | A1 | 10/2017 | Usui et al. | |
| 2019/0145391 | A1 | 5/2019 | Davids | |
| 2020/0347706 | A1 | 11/2020 | Nowell et al. | |

FOREIGN PATENT DOCUMENTS

| | | | |
|---|---|---|---|
| EP | 0580196 | A1 | 1/1994 |
| EP | 1103722 | A2 | 5/2001 |
| EP | 2383470 | A1 | 11/2011 |
| GB | 120622 | A | 11/1918 |
| GB | 150645 | A | 7/1936 |
| GB | 572173 | A | 5/1952 |
| GB | 1226014 | A | 3/1971 |
| GB | 1262826 | A | 2/1972 |
| JP | 53001012 | Y2 | 1/1988 |
| JP | 2002037217 | A | 2/2002 |
| JP | 2004257283 | A | 9/2004 |
| JP | 4121804 | B2 | 7/2008 |
| JP | 2009131747 | A | 6/2009 |
| JP | 5107651 | B2 | 12/2012 |
| JP | 2020040010 | A | 3/2020 |

OTHER PUBLICATIONS

Foreign Communication from Related Application—International Search Report and Written Opinion of the International Searching Authority, International Application No. PCT/US2020/022043, dated Jul. 3, 2020, 13 pages.

Kiani, Mahdi et al., "Numerical Modeling and Analytical Investigation of Autofrettage Process on the Fluid End Module of Fracture Pumps," Journal of Pressure Vessel Technology, Aug. 2018, pp. 0414031-0414037, vol. 140, ASME.

"Pump Catalog," Cat Pumps, Inc., 2014, 24 pages.

Furuta, Katsunori et al., " Study of the In-Line Pump System for Diesel Engines to Meet Future Emission Regulations," SAE International Congress and Exposition, Feb. 1998, pp. 125-136, Society of Automotive Engineers, Inc.

"550 Series: High Pressure, High Flow Water Jetting," Gardner Denver Water Jetting Systems, Inc., 2009, 4 pages.

Houghton, J.E. et al., "Improved Pump Run Time Using Snow Auto-Rotating Plunger (SARP) Pump," SPE Western Regional Meeting, May 1998, SPE46217, 6 pages, Society of Petroleum Engineers, Inc.

"Improved Double Acting Pump, Scientific American," 1867, pp. 248, vol. 17, No. 16, American Periodicals.

Langewis, Jr., C. et al., "Practical Hydraulics of Positive Displacement Pumps for High-Pressure Waterflood Installations," Journal of Petroleum Technology, Feb. 1971, pp. 173-179, SPE-AIME/Continental Oil Co.

Petzold, Martin et al., " Visualization and Analysis of the Multiphase Flow in an Electromagnetically Driven Dosing Pump," ASME/BATH Symposium on Fluid Power & Motion Control, Oct. 2013, FPMC2013-4433, 6 pages, ASME.

Romer, M. C. et al., "Field Trial of a Novel Self-Reciprocating Hydraulic Pump for Deliquification," SPE Production & Operations, 2017, 12 pages, Society of Petroleum Engineers.

* cited by examiner

DISCHARGE VALVE DISABLER AND PRESSURE PULSE GENERATOR THEREFROM

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates generally to a method and apparatus for supplying pressurized fluids. More particularly, the present disclosure relates to methods and reciprocating devices for pumping fluids into a wellbore.

BACKGROUND

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. Such design considerations may concern the ability to rapidly cease pumping of fluids by the pump and/or the ability to pump fluids into a formation in a pulsed pressure manner.

Accordingly, it is desirable to provide a pump fluid end that enables for rapid disablement of the pump and/or the pumping of fluids in a manner that subjects a formation to pulsating pressures.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 5:
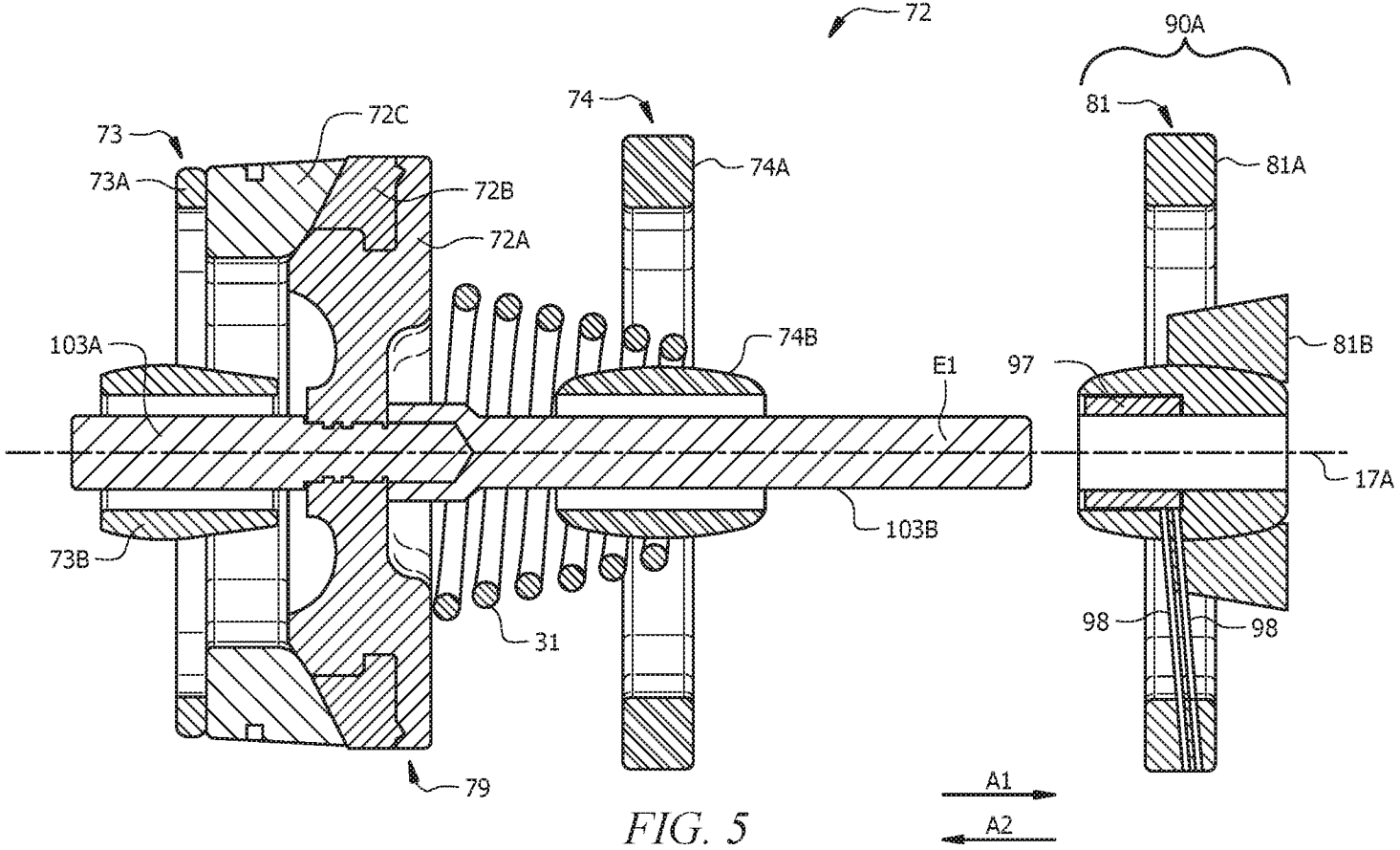
FIG. 5 is a schematic cross section view of a discharge valve assembly, according to embodiments of this disclosure.
Figure 6A:
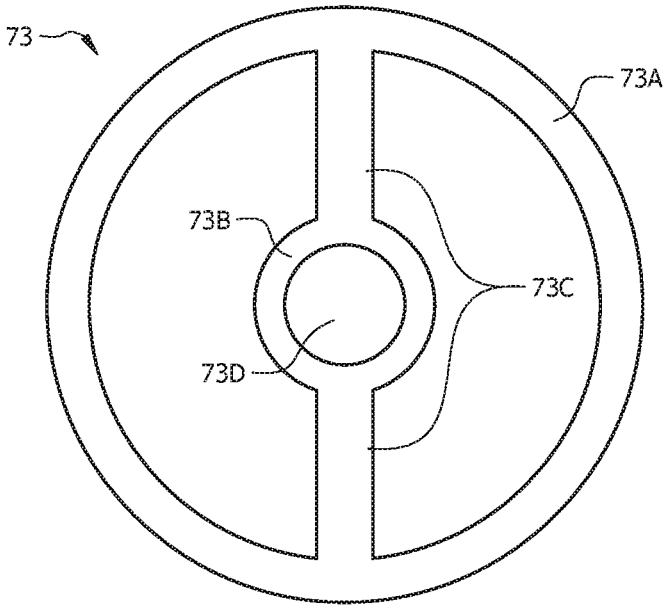
FIG. 6A is a schematic front view of a left side valve guide, according to embodiments of this disclosure.
Figure 6B:
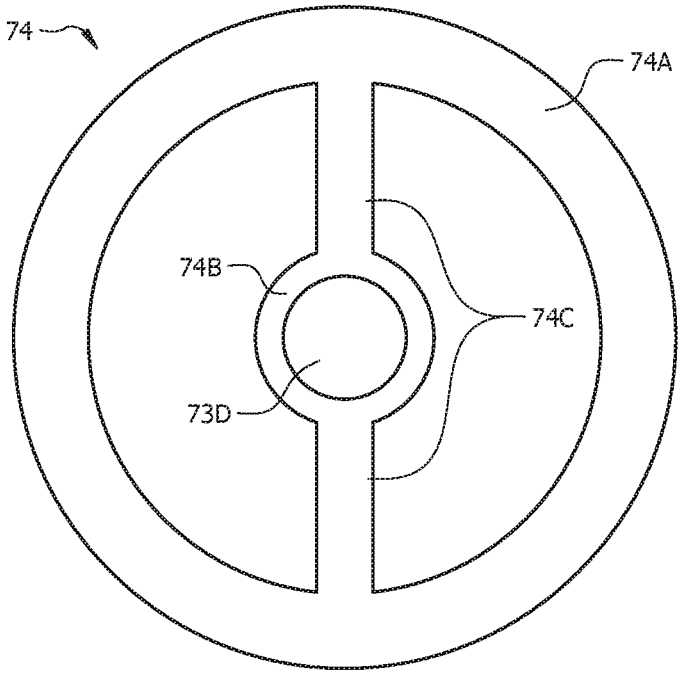
FIG. 6B is a schematic front view of a right side valve guide, according to embodiments of this disclosure.
Figure 6C:
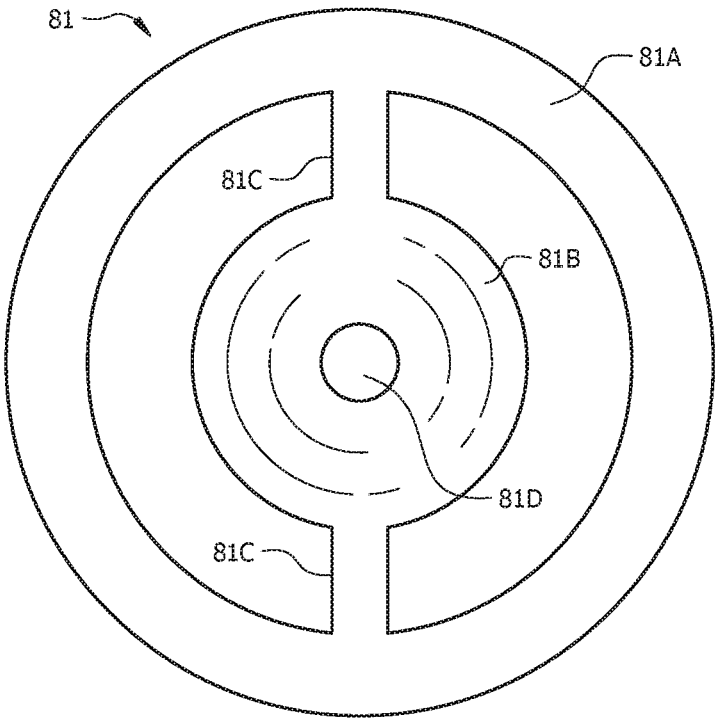
FIG. 6C is a schematic front view of a valve arrestor, according to embodiments of this disclosure.

A descriptor numeral can be utilized generically herein to refer to any embodiment of that component. For example, generic reference to a "controllable holding system (CHS) 90" can indicate any suitable CHS 90, such as electromagnetically actuatable controllable holding system 90A, as depicted in FIG. 5 described hereinbelow, and hydraulically actuatable controllable holding system 90B, as depicted in FIGS. 6A-6C described hereinbelow.

Disclosed herein is a reciprocating apparatus for pumping pressurized fluid. In embodiments, the reciprocating apparatus comprises a pump fluid end containing a discharge valve assembly configured to control fluid flow out of a chamber of the pump fluid end of the pump. The discharge valve assembly comprises a controllable holding system (CHS) that is controllable to hold the discharge valve assembly in an open configuration. In embodiments, the reciprocating apparatus is a high-pressure pump configured to operate at a pressure greater than or equal to about 3,000 psi and/or in a well servicing operation and environment. As detailed further hereinbelow, utilization of a discharge valve assembly of this disclosure can enable rapid disablement of the pump, whereby pumping of fluids is ceased, and/or can provide for the pumping of fluids into a formation in a manner that subjects the formation to pulsating pressures.

Figure 1:
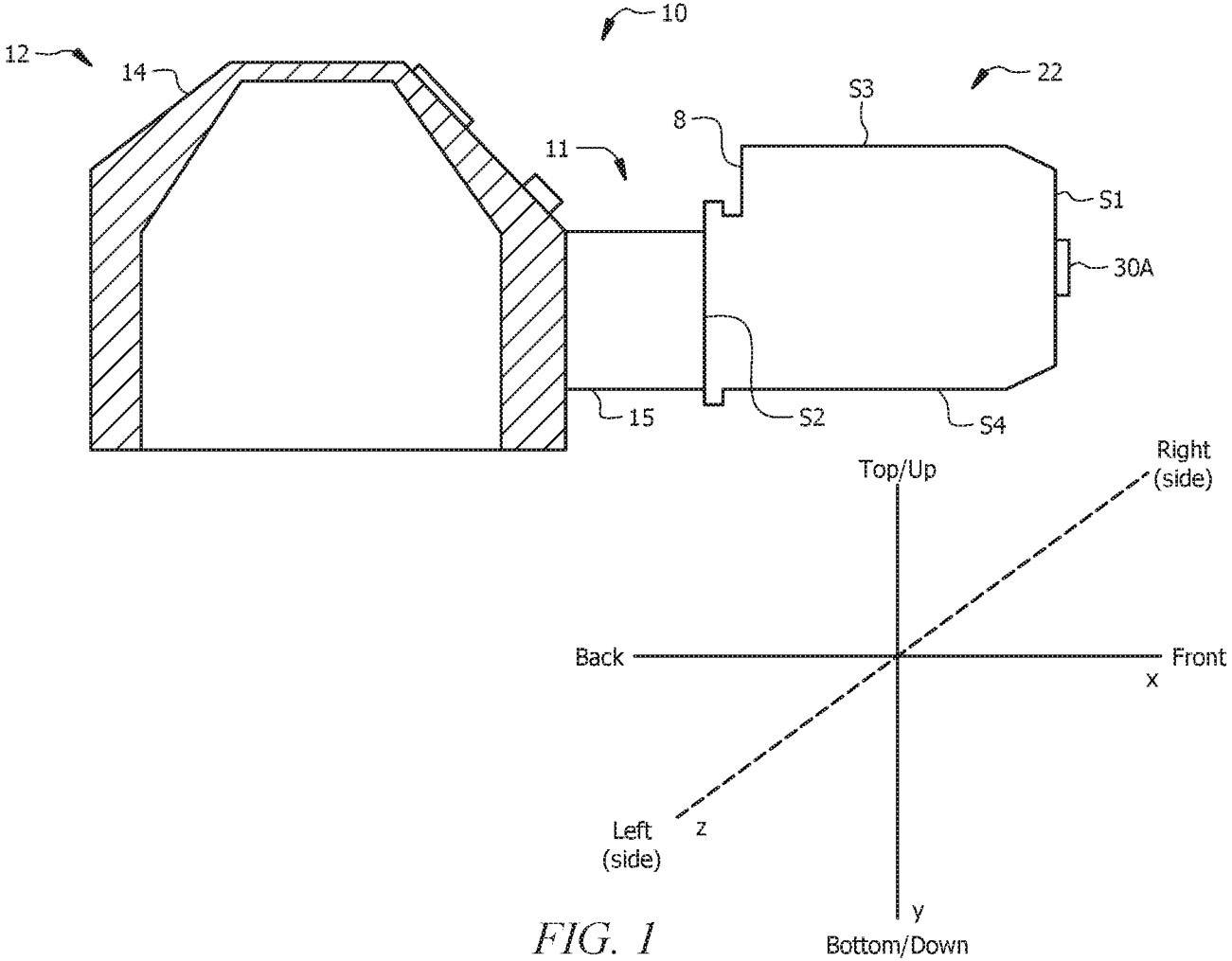
FIG. 1 is an elevational view of a reciprocating pump, according to embodiments of this disclosure.

A reciprocating apparatus of this disclosure may comprise any suitable pump operable to pump fluid. Non-limiting examples of suitable pumps include, but are not limited to, piston pumps, plunger pumps, and the like. In embodiments, the pump is a rotary- or reciprocating-type pump such as a positive displacement pump operable to displace pressurized fluid. The pump comprises a pump power end, a pump fluid end, and an integration section whereby a reciprocating element (e.g., a plunger) can be mechanically connected with the pump power end such that the reciprocating element can be reciprocated within a reciprocating element bore of the pump fluid end. FIG. 1 is an elevational view (e.g., side view) of a pump 10 (e.g., a reciprocating pump) according to an exemplary embodiment, the reciprocating pump comprising a pump power end 12, a pump fluid end 22, and an integration section 11. As illustrated in FIG. 1, pump fluid end has a front S1 opposite a back S2 along a first or x-axis, a top S3 opposite a bottom S4 along a second or y-axis, wherein the y-axis is in the same plane as and perpendicular to the x-axis, and a left side and a right side along a z-axis, wherein the z-axis is along a plane perpendicular to the plane of the x-axis and the y-axis. Accordingly, toward the top of pump fluid end 22 (and pump 10) is along the y-axis toward top S3, toward the bottom of pump fluid end 22 (and pump 10) is along the y-axis toward bottom S4, toward the front of pump fluid end 22 (and pump 10) is along the x-axis toward front S1, and toward the back of pump fluid end 22 (and pump 10) is along the x-axis away from front S1.

Figure 2A:
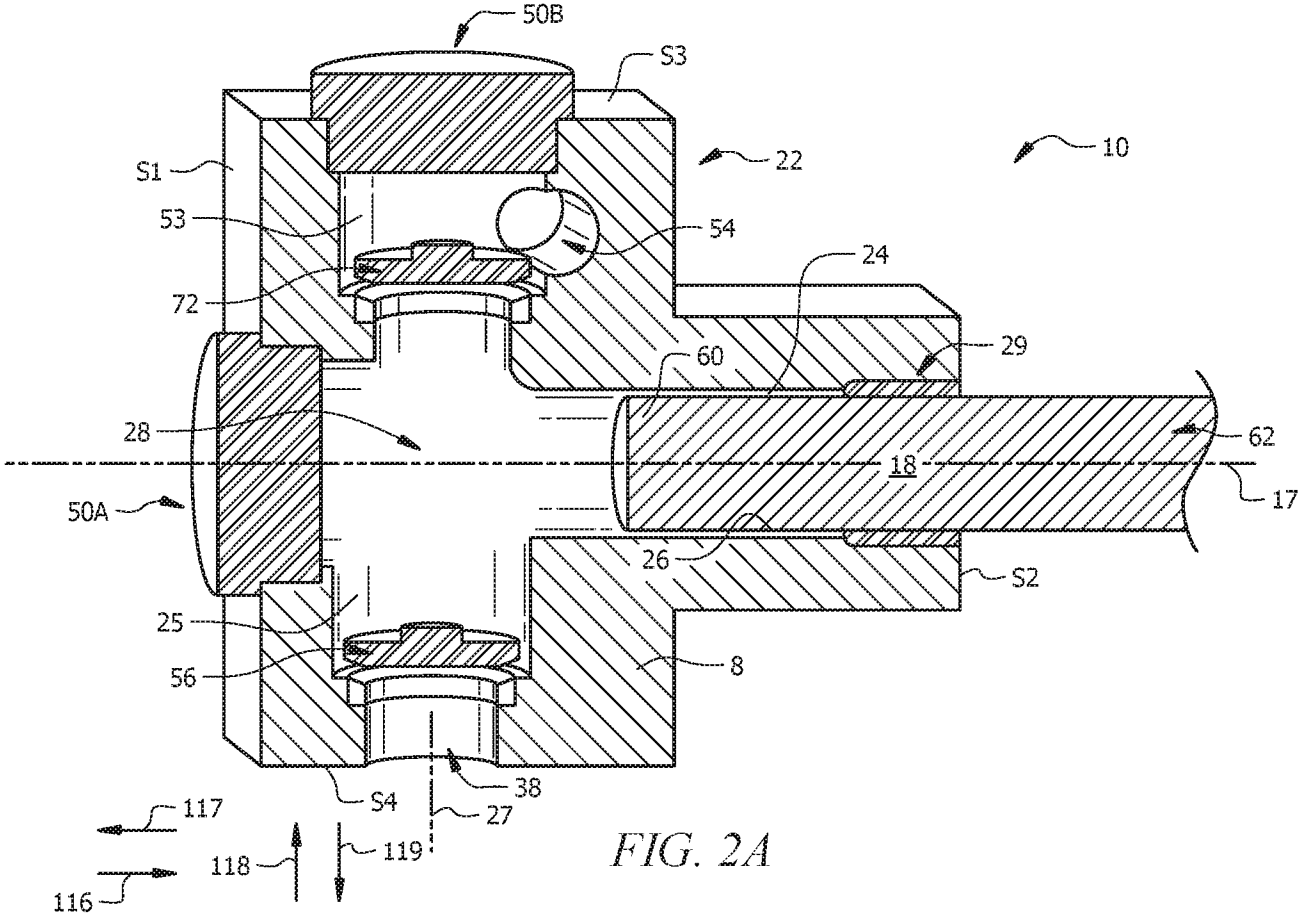
FIG. 2A is a cut-away illustration of an exemplary reciprocating pump comprising a cross-bore pump fluid end, according to embodiments of the present disclosure.
Figure 2B:
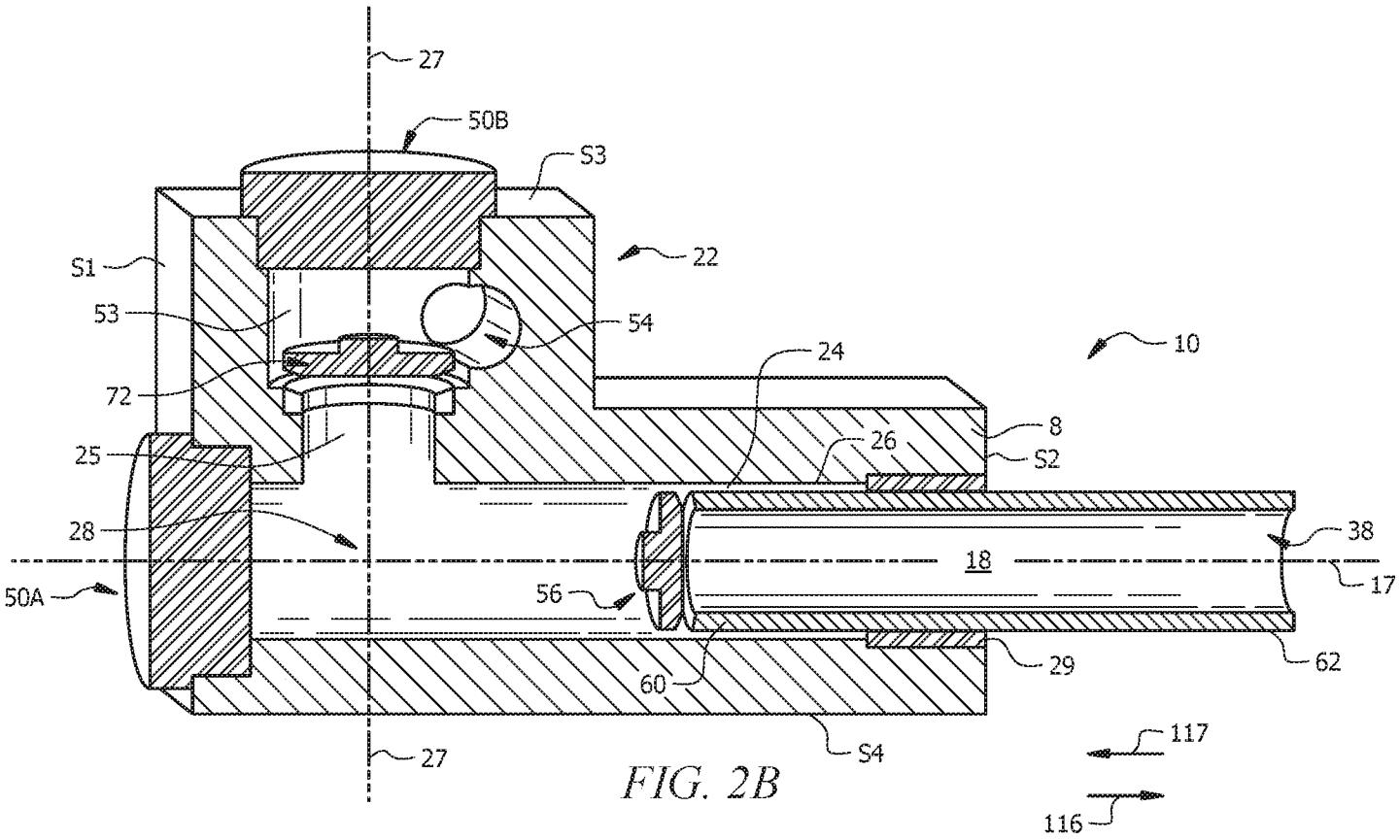
FIG. 2B is a cut-away illustration of an exemplary reciprocating pump comprising a cross-bore pump fluid end, according to other embodiments of the present disclosure.
Figure 3:
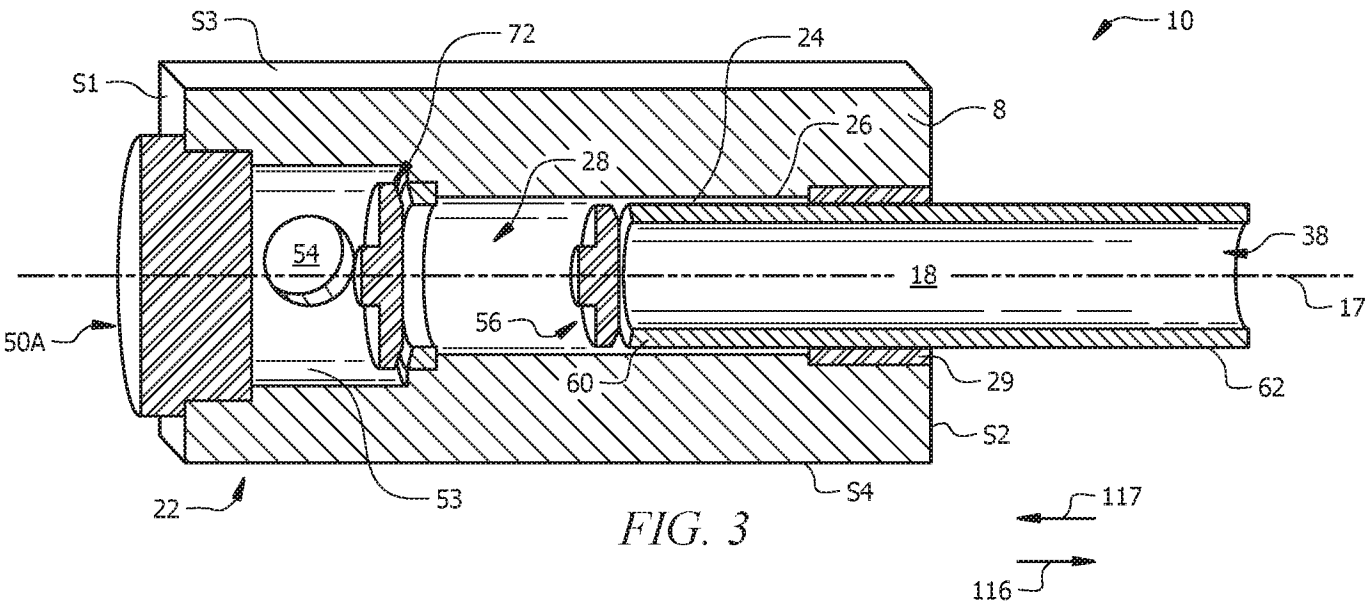
FIG. 3 is a cut-away illustration of an exemplary reciprocating pump comprising a concentric bore pump fluid end, according to embodiments of the present disclosure.

The pump fluid end 22 is integrated with the pump power end 12 via the integration section 11, such that pump power end 12 is operable to reciprocate the reciprocating element 18 within a reciprocating element bore 24 (FIGS. 2-3) of the pump fluid end 22. The reciprocating element bore 24 is at least partially defined by a cylinder wall 26. As described further hereinbelow with reference to FIGS. 2A-2B and FIG. 3, pump fluid end 22 can be a multi-bore pump fluid end (also referred to herein as a cross-bore pump fluid end) 22 or, alternatively, an in-line or "concentric" bore pump fluid end. As utilized herein, multi-bore pump fluid ends can comprise "T-bore" pump fluid ends, "X-bore" (e.g., cross shaped bore) pump fluid ends, or "Y-bore" pump fluid ends. FIG. 2A is a schematic showing a cross-bore pump fluid end 22 engaged with a reciprocating element 18, wherein the cross-bore pump fluid end 22 comprises a cross-bore 25 that makes a cross shape (+) relative to reciprocating element bore 24. FIG. 2B is a schematic showing a cross-bore pump fluid end 22 engaged with a reciprocating element 18, wherein the cross bore pump fluid end 22 comprises a tee-bore 25 that makes a "T" shape relative to reciprocating element bore 24. FIG. 3 is a schematic showing a concentric bore pump fluid end 22 engaged with a reciprocating element 18. As discussed further below, the pump 10 includes at least one fluid inlet 38 for receiving fluid from a fluid source, e.g., a suction line, suction header, storage or mix tank, blender, discharge from a boost pump such as a centrifugal pump, etc. The pump 10 also includes at least one discharge outlet 54 for discharging fluid to a discharge source, e.g., a flowmeter, pressure monitoring and control system, distribution header, discharge line, wellhead, discharge manifold pipe, and the like.

The pump 10 may comprise any suitable pump power end 12 for enabling the pump 10 to perform pumping operations (e.g., pumping a wellbore servicing fluid downhole). Similarly, the pump 10 may include any suitable housing 14 for containing and/or supporting the pump power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the pump power end 12 and/or other pump components. As such, the pump 10 may be inspected to determine whether parts need to be repaired or replaced. The pump power end may also be hydraulically driven, whether it is a non-intensifying or an intensifying system.

Figure 4:
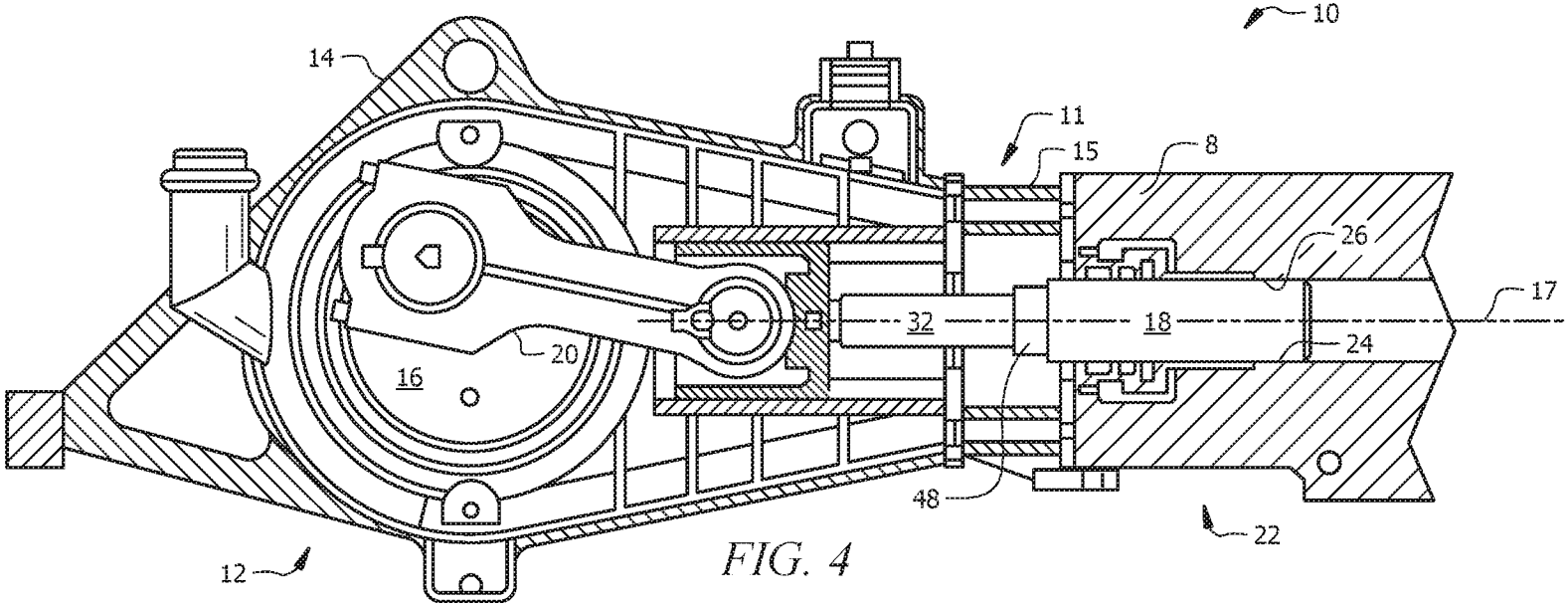
FIG. 4 is cut-away illustration of a pump power end of a pump, according to embodiments of the present disclosure.

Those versed in the art will understand that the pump power end 12 may include various components commonly employed in pumps. Pump power end 12 can be any suitable pump known in the art and with the help of this disclosure to be operable to reciprocate reciprocating element 18 in reciprocating element bore 24. For example, without limitation, pump power end 12 can be operable via and comprise a crank and slider mechanism, a powered hydraulic/pneumatic/steam cylinder mechanism or various electric, mechanical or electro-mechanical drives. FIG. 4 provides a cutaway illustration of an exemplary pump 10 of this disclosure, showing an exemplary pump power end 12, integrated via integration section 11 with a pump fluid end 22, wherein the pump power end 12 is operable to reciprocate the reciprocating element 18 within a reciprocating element bore 24 of the pump fluid end 22. Briefly, for example, the pump power end 12 may include a rotatable crankshaft 16 attached to at least one reciprocating element 18 (e.g., a plunger or piston) by way of a crank arm/connecting rod 20. Additionally, an engine (e.g., a diesel engine), motor, or other suitable power source may be operatively connected to the crankshaft 16 (e.g., through a transmission and drive shaft) and operable to actuate rotation thereof. In operation, rotation of the crankshaft 16 induces translational movement of the crank arm/connecting rod 20, thereby causing the reciprocating element 18 to extend and retract along a flow path, which may generally be defined by a central axis 17 within a reciprocating element bore 24 (sometimes referred to herein for brevity as a "reciprocating element bore 24" or simply a "bore 24", and not wishing to be limited to a particular reciprocating element 18). Pump 10 of FIG. 1 is typically mounted on a movable structure such as a semi-tractor trailer or skid, and the moveable structure may contain additional components, such as a motor or engine (e.g., a diesel engine), that provides power (e.g., mechanical motion) to the pump power end 12 (e.g., a crankcase comprising crankshaft 16 and related connecting rods 20).

Of course, numerous other components associated with the pump power end 12 of the pump 10 may be similarly employed, and therefore, fall within the purview of the present disclosure. Furthermore, since the construction and operation of components associated with pumps of the sort depicted in FIG. 1 are well known and understood, discussion of the pump 10 will herein be limited to the extent necessary for enabling a proper understanding of the disclosed embodiments.

As noted hereinabove, the pump 10 comprises a pump fluid end 22 attached to the pump power end 12. Various embodiments of the pump fluid end 22 are described in detail below in connection with other drawings, for example FIGS. 2A-2B and FIG. 3. Generally, the pump fluid end 22 comprises at least one fluid inlet 38 for receiving fluid, and at least one discharge outlet 54 through which fluid flows out of the discharge chamber 53. The pump fluid end 22 also comprises at least one valve assembly for controlling the receipt and output of fluid. For example, the pump fluid end 22 can comprise a suction valve assembly 56 and a discharge valve assembly 72. The pump fluid end 22 may include any suitable component(s) and/or structure(s) for containing and/or supporting the reciprocating element 18 and providing a cylinder wall 26 at least partially defining a reciprocating element bore 24 along which the pump power end can reciprocate the reciprocating element during operation of the pump.

In embodiments, the pump fluid end 22 may comprise a cylinder wall 26 at least partially defining a bore 24 through which the reciprocating element 18 may extend and retract. Additionally, the bore 24 may be in fluid communication with a discharge chamber 53 formed within the pump fluid end 22. Such a discharge chamber 53, for example, may be configured as a pressurized discharge chamber 53 having a discharge outlet 54 through which fluid is discharged by the reciprocating element 18. Thus, the reciprocating element 18 may be movably disposed within the reciprocating element bore 24, which may provide a fluid flow path into and/or out of the pump chamber. During operation of the pump 10, the reciprocating element 18 may be configured to reciprocate along a path (e.g., along central axis 17 within bore 24 and/or pump chamber 28, which corresponds to reciprocal movement parallel to the x-axis of FIG. 1) to transfer a supply of fluid to the pump chamber 28 and/or discharge fluid from the pump chamber 28.

In operation, the reciprocating element 18 extends and retracts along a flow path to alternate between providing forward strokes (also referred to as discharge strokes and correlating to movement in a positive direction parallel to the x-axis of FIG. 1, indicated by arrow 117) and return strokes (also referred to as suction strokes and correlating to movement in a negative direction parallel to the x-axis of FIG. 1, indicated by arrow 116), respectively. During a forward stroke, the reciprocating element 18 extends away from the pump power end 12 and toward the pump fluid end 22. Before the forward stoke begins, the reciprocating element 18 is in a fully retracted position (also referred to as bottom dead center (BDC) with reference to the crankshaft 16), in which case the suction valve assembly 56 can be in a closed configuration having allowed fluid to flow into the (e.g., high pressure) pump chamber 28. (As utilized here, "high pressure" indicates possible subjection to high pressure during discharge.) When discharge valve assembly 72 is in a closed configuration (e.g., under the influence of a closing mechanism, such as a spring), the high pressure in a discharge pipe or manifold containing discharge outlet 54 prevents fluid flow into discharge chamber 53 and causes pressure in the pump chamber 28 to accumulate upon stroking of the reciprocating element 18. When the reciprocating element 18 begins the forward stroke, the pressure builds inside the pump chamber 28 and acts as an opening force that results in positioning of the discharge valve assembly 72 in an open configuration, while a closing force (e.g., via a closing mechanism, such as a spring and/or pressure increase inside pump chamber 28) urges the suction valve assembly 56 into a closed configuration. When utilized in connection with a valve assembly, 'open' and 'closed' refer, respectively, to a configuration in which fluid can flow through the valve assembly (e.g., can pass between a valve body (e.g., a movable poppet) and a carrier or a valve seat thereof) and a configuration in which fluid cannot flow through the valve assembly (e.g., cannot pass between a valve body (e.g., a movable poppet) and a carrier or a valve seat thereof). As the reciprocating element 18 extends forward, fluid within the pump chamber 28 is discharged through the discharge outlet 54.

During a return stroke, the reciprocating element 18 reciprocates or retracts away from the pump fluid end 22 and towards the pump power end 12 of the pump 10. Before the return stroke begins, the reciprocating element 18 is in a fully extended position (also referred to as top dead center (TDC) with reference to the crankshaft 16), in which case the discharge valve assembly 72 can be in a closed configuration having allowed fluid to flow out of the pump chamber 28 and the suction valve assembly 56 is in a closed configuration. When the reciprocating element 18 begins and retracts towards the pump power end 12, the discharge valve assembly 72 assumes a closed configuration, while the suction valve assembly 56 opens. As the reciprocating element 18 moves away from the discharge valve 72 during a return stroke, fluid flows through the suction valve assembly 56 and into the pump chamber 28.

With reference to the embodiments of FIG. 2A, which is a schematic showing a cross-bore pump fluid end 22 engaged with a reciprocating element 18, cross-bore pump fluid end 22 comprises a cross-bore fluid end body 8, a cross-bore pump chamber 28, a suction valve assembly 56, and a discharge valve assembly 72. In this cross-bore configuration, suction valve assembly 56 and discharge valve assembly 72 are located in a bore or channel 25 (also referred to herein as a cross bore 25) of pump chamber 28, wherein bore 25 has a central axis 27 that is parallel to the y-axis of FIG. 1 and is perpendicular to bore 24 in which reciprocating element 18 reciprocates during operation. Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 2B, which is a schematic showing a T-bore pump fluid end 22 engaged with a reciprocating element 18, T-bore pump fluid end 22 comprises a T-bore fluid end body 8, a T-shaped pump chamber 28, a suction valve assembly 56, and a discharge valve assembly 72. In this T-bore configuration of FIG. 2B, suction valve assembly 56 is coupled with front end 60 of reciprocating element 18 and discharge valve assembly 72 is positioned in bore 25 that makes a tee with reciprocating element bore 24, i.e., central axis 17 of reciprocating element bore 24 is also the central axis of suction pump assembly 56 and perpendicular to a central axis 27 of discharge valve assembly 72 (i.e., central axis 27 is parallel to the y-axis of FIG. 1 and is perpendicular to bore 24 in which reciprocating element 18 reciprocates during operation). Suction valve assembly 56 and discharge valve assembly 72 are operable to direct fluid flow within the pump 10. When reciprocating element 18 retracts, or moves along central axis 17 in a direction away from the pump chamber 28 and the pump fluid end 22 and toward the pump power end 12 (as indicated by arrow 116), a suction valve of the suction valve assembly 56 opens (e.g., either under natural flow or other biasing means), and a discharge valve of discharge valve assembly 72 will be closed, whereby fluid enters pump chamber 28 via fluid inlet 38. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge outlet 54.

With reference to the embodiment of FIG. 3, which is a schematic showing a concentric pump fluid end 22 engaged with a reciprocating element 18, concentric bore pump fluid end 22 comprises a concentric bore fluid end body 8, a concentric pump chamber 28, a suction valve assembly 56, and a discharge valve assembly 72. In this concentric bore configuration, suction valve assembly 56 and discharge valve assembly 72 are positioned in-line (also referred to as coaxial) with reciprocating element bore 24, i.e., central axis 17 of reciprocating element bore 24 is also the central axis of suction pump assembly 56 and discharge valve assembly 72). Suction valve assembly 56 and discharge valve assembly 72 are operable to direct fluid flow within the pump 10. In some concentric bore fluid end designs, fluid flows within a hollow reciprocating element (e.g., a hollow plunger) 18. In some such embodiments, the reciprocating element bore 24 of such a concentric bore fluid end design can be defined by a high pressure cylinder 26 providing a high pressure chamber and a low pressure cylinder (not depicted in the embodiment of FIG. 3) providing a low pressure chamber toward tail end 62 of reciprocating element 18, whereby fluid from fluid inlet 38 enters reciprocating element 18. When reciprocating element 18 retracts, or moves along central axis 17 in a direction away from the pump chamber 28 and pump fluid end 22 and toward pump power end 12 (as indicated by arrow 116), a suction valve of the suction valve assembly 56 opens (e.g., either under natural flow and/or other biasing means), and a discharge valve of discharge valve assembly 72 will be closed, whereby fluid enters pump chamber 28 via a fluid inlet 38. For a concentric bore pump fluid end 22 design, the fluid inlet can be configured to introduce fluid into pump chamber 28 via a reciprocating element 18 that is hollow and/or via a low pressure chamber as described above. When the reciprocating element 18 reverses direction, due to the action of the pump power end 12, the reciprocating element 18 reverses direction along central axis 17, now moving in a direction toward the pump chamber 28 and pump fluid end 22 and away from pump power end 12 (as indicated by arrow 117), and the discharge valve of discharge valve assembly 72 is open and the suction valve of suction valve assembly 56 is closed (e.g., again either due to fluid flow and/or other biasing means of valve control), such that fluid is pumped out of pump chamber 28 via discharge chamber 53 and discharge outlet 54.

A pump 10 of this disclosure can comprise one or more access ports. For example, with reference to the cross-bore fluid end body 8 embodiments of FIG. 2A and FIG. 2B, a front access port 50A can be located on a front S1 of the pump fluid end 22 opposite a back S2 of the pump fluid end 22, wherein the back S2 of the pump fluid end is proximal the pump power end 12, upon integration therewith via integration section 11. A top access port 50B can be located on a top S3 of the pump fluid end 22 opposite a bottom S4 of the pump fluid end 22, wherein the top S1 of the pump fluid end 22 is above central axis 17 and the bottom S4 of the pump fluid end 22 is below central axis 17. With reference to the concentric fluid end body 8 embodiment of FIG. 3, a front access port 50A can be located on a front S1 of the pump fluid end 22 opposite a back S2 of the pump fluid end 22, wherein the back S2 of the pump fluid end is proximal the pump power end 12, upon integration therewith via integration section 11. Locations described as front S1, back S2, top S3, and bottom S4 are further described with reference to the x-y-z coordinate system shown in FIG. 1 and further can be relative to a surface (e.g., a trailer bed, the ground, a platform, etc.) upon which the pump 10 is located, a bottom S4 of the pump fluid end being proximal the surface (e.g., trailer bed) upon which the pump 10 is located. Generally, due to size and positioning of pump 10, the front S1 and top S3 of the pump fluid end 22 are more easily accessible than a back S2 or bottom S4 thereof. In a similar manner, a front of pump 10 is distal the pump power end 12 and a back of the pump 10 is distal the pump fluid end 22. The integration section 11 can be positioned in a space between the pump fluid end 22 and the pump power end 12, and can be safeguarded (e.g., from personnel) via a cover 15.

In embodiments, a pump fluid end 22 and pump 10 of this disclosure comprise at least one access port located on a side of the discharge valve assembly 72 opposite the suction valve assembly 56. For example, in the cross-bore pump fluid end 22 embodiment of FIG. 2A, top access port 50B is located on a side (e.g., top side) of discharge valve assembly 72 opposite suction valve assembly 56, while in the concentric bore pump fluid end 22 embodiment of FIG. 3, front access port 50A is located on a side (e.g., front side) of discharge valve assembly 72 opposite suction valve assembly 56.

In embodiments, one or more seals 29 (e.g., "o-ring" seals, packing seals, or the like), also referred to herein as 'primary' reciprocating element packing 29 (or "packing 29") may be arranged around the reciprocating element 18 to provide sealing between the outer walls of the reciprocating element 18 and the inner walls 26 defining at least a portion of the reciprocating element bore 24. The inner walls 26 may be provided by fluid end body 8 or a sleeve within reciprocating element bore 24, as described below. In some concentric bore fluid end designs, a second set of seals (also referred to herein as 'secondary' reciprocating element packing; not shown in the Figures) may be fixedly arranged around the reciprocating element 18 to provide sealing between the outer walls of the reciprocating element 18 and the inner walls of a low-pressure cylinder that defines the low pressure chamber described hereinabove (e.g., wherein the secondary packing is farther back along the x-axis and delineates a back end of the low pressure chamber that extends from the primary packing 29 to the secondary packing). In embodiments, only a primary reciprocating element packing is utilized, as fluid enters tail end 62 of reciprocating element 18 without first contacting an outer peripheral wall thereof (i.e., no secondary reciprocating element packing is needed/utilized, because no low pressure chamber external to reciprocating element 18 is utilized). Skilled artisans will recognize that the seals may comprise any suitable type of seals, and the selection of seals may depend on various factors e.g., fluid, temperature, pressure, etc.

While the foregoing discussion focused on a pump fluid end 22 comprising a single reciprocating element 18 disposed in a single reciprocating element bore 24, it is to be understood that the pump fluid end 22 may include any suitable number of reciprocating elements. As discussed further below, for example, the pump 10 may comprise a plurality of reciprocating elements 18 and associated reciprocating element bores 24 arranged in parallel and spaced apart along the z-axis of FIG. 1 (or another arrangement such as a V block or radial arrangement). In such a multi-bore pump, each reciprocating element bore may be associated with a respective reciprocating element and crank arm, and a single common crankshaft may drive each of the plurality of reciprocating elements and crank arms. Alternatively, a multi-bore pump may include multiple crankshafts, such that each crankshaft may drive a corresponding reciprocating element. Furthermore, the pump 10 may be implemented as any suitable type of multi-bore pump. In a non-limiting example, the pump 10 may comprise a Triplex pump having three reciprocating elements 18 (e.g., plungers or pistons) and associated reciprocating element bores 24, discharge valve assemblies 72 and suction valve assemblies 56, or a Quintuplex pump having five reciprocating elements 18 and five associated reciprocating element bores 24, discharge valve assemblies 72 and suction valve assemblies 56.

Reciprocating element bore 24 can have an inner diameter slightly greater than the outer diameter of the reciprocating element 18, such that the reciprocating element 18 may sufficiently reciprocate within reciprocating element bore 24 (optionally, within a sleeve, as described hereinbelow). In embodiments, the fluid end body 8 of pump fluid end 22 has a pressure rating ranging from about 100 psi to about 3000 psi, or from about 2000 psi to about 10,000 psi, from about 5000 psi to about 30,000 psi, or from about 3000 psi to about 50,000 psi or greater. The fluid end body 8 of pump fluid end 22 may be cast, forged, machined, printed or formed from any suitable materials, e.g., steel, metal alloys, or the like. Those versed in the art will recognize that the type and condition of material(s) suitable for the fluid end body 8 may be selected based on various factors. In a wellbore servicing operation, for example, the selection of a material may depend on flow rates, pressure rates, wellbore service fluid types (e.g., particulate type and/or concentration present in particle laden fluids such as fracturing fluids or drilling fluids, or fluids comprising cryogenic/foams), etc. Moreover, the fluid end body 8 (e.g., cylinder wall 26 defining at least a portion of reciprocating element bore 24 and/or pump chamber 28) may include protective coatings for preventing and/or resisting abrasion, erosion, and/or corrosion.

In embodiments, the cylindrical shape (e.g., providing cylindrical wall(s) 26) of the fluid end body 8 may be pre-stressed in an initial compression. Moreover, a high-pressure cylinder(s) providing the cylindrical shape (e.g., providing cylindrical wall(s) 26) may comprise one or more sleeves (e.g., heat-shrinkable sleeves). Additionally or alternatively, the high-pressure cylinder(s) may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components (e.g., providing cylindrical wall 26) associated with the pump fluid end body 8 of pump fluid end 22 may be held in place within the pump 10 using any appropriate technique. For example, components may be assembled and connected, e.g., bolted, welded, etc. Additionally or alternatively, cylinders may be press-fit (e.g., interference fit) into openings machined or cast into the pump fluid end 22 or other suitable portion of the pump 10. Such openings may be configured to accept and rigidly hold cylinders (e.g., having cylinder wall(s) 26 at least partially defining reciprocating element bore 24) in place so as to facilitate interaction of the reciprocating element 18 and other components associated with the pump 10.

In embodiments, the reciprocating element 18 comprises a plunger or a piston. While the reciprocating element 18 may be described herein with respect to embodiments comprising a plunger, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals (e.g., primary seal or packing 29) through which the plunger moves during each stroke (e.g., suction stroke or discharge stroke).

As skilled artisans will understand, the reciprocating element 18 may include any suitable size and/or shape for extending and retracting along a flow path within the pump fluid end 22. For instance, reciprocating element 18 may comprise a generally cylindrical shape, and may be sized such that the reciprocating element 18 can sufficiently slide against or otherwise interact with the inner cylinder wall 26. In embodiments, one or more additional components or mechanical linkages 48 (FIG. 4; e.g., clamps, adapters, extensions, etc.) may be used to couple the reciprocating element 18 to the pump power end 12 (e.g., to a pushrod 9).

In some embodiments (e.g., cross-bore pump fluid end 22 embodiments such as FIG. 2A), the reciprocating element may be substantially solid and/or impermeable (e.g., not hollow). In alternative embodiments (e.g., tee-bore pump fluid end 22 embodiment such as FIG. 2B and concentric bore pump fluid end 22 embodiment such as FIG. 3), the reciprocating element 18 comprises a peripheral wall defining a hollow body. Additionally (e.g., tee-bore pump fluid end 22 embodiments such as FIG. 2B and concentric bore pump fluid end 22 embodiments such as FIG. 3), a portion of the peripheral wall of reciprocating element 18 may be generally permeable or may include an input through which fluid may enter the hollow body and an output through which fluid may exit the hollow body. Furthermore, while the reciprocating element 18 may, in embodiments, define a substantially hollow interior and include a ported body, a base of the reciprocating element 18 proximal the pump power end 12, when assembled, may be substantially solid and/or impermeable (e.g., a plunger having both a hollow portion and a solid portion).

The reciprocating element 18 comprises a front or free end 60. In embodiments comprising concentric bore pump fluid end designs 22 such as shown in FIG. 3, the reciprocating element 18 can contain or at least partially contain the suction valve assembly 56. In one aspect, the suction valve assembly 56 is at least partially disposed within the reciprocating element 18 at or proximate to the front end 60 thereof. At an opposite or tail end 62 (also referred to as back end 62) of the reciprocating element 18, the reciprocating element 18 may include a base coupled to the pump power end 12 of the pump 10 (e.g., via crank arm 20). In embodiments, the tail end 62 of the reciprocating element 18 is coupled to the pump power end 12 outside of pump fluid end 22, e.g., within integration section 11.

As noted above, pump fluid end 22 contains a suction valve assembly 56. Suction valve assembly 56 may alternately open or close to permit or prevent fluid flow. Skilled artisans will understand that the suction valve assembly 56 may be of any suitable type or configuration (e.g., gravity- or spring-biased, flow activated, etc.). Those versed in the art will understand that the suction valve assembly 56 may be disposed within the pump fluid end 22 at any suitable location therein. For instance, the suction valve assembly 56 may be disposed within the bore 25 below central axis 17 of the pump fluid end 22, in cross-bore pump fluid end 22 designs such as FIG. 2A, such that a suction valve body (e.g., a poppet) of the suction valve assembly 56 moves toward central axis 17 when the suction valve assembly 56 opening and away from the central axis 17 when the suction valve assembly 56 is closing. The suction valve assembly 56 may be disposed within reciprocating element bore 24 and at least partially within reciprocating element 18 in tee-bore pump fluid end 22 designs such as FIG. 2B and concentric bore pump fluid end 22 designs such as FIG. 3, such that a suction valve body (e.g., a poppet) of the suction valve assembly 56 moves away from the reciprocating element 18 when the suction valve assembly 56 approaches an open configuration (i.e., is opening) and toward reciprocating element 18 when the suction valve assembly 56 approaches a closed configuration (i.e., is closing).

Pump 10 comprises a discharge valve assembly 72 for controlling the output of fluid through discharge chamber 53 and discharge outlet 54. Analogous to the suction valve assembly 56, the discharge valve assembly 72 may alternately open or close to permit or prevent fluid flow. Those versed in the art will understand that the discharge valve assembly 72 may be disposed within the pump chamber at any suitable location therein. For instance, the discharge valve assembly 72 may be disposed within the bore 25 proximal the top S3 of the pump fluid end 22, in cross-bore pump fluid end 22 designs such as FIG. 2A and tee-bore pump fluid end 22 designs such as FIG. 2B, such that a discharge valve body (e.g., a poppet) of the discharge valve assembly 72 moves toward the discharge chamber 53 when the discharge valve assembly 72 approaches an open configuration and away from the discharge chamber 53 when the discharge valve assembly 72 approaches a closed configuration. The discharge valve assembly 72 may be disposed proximal the front S1 of bore 24 of the pump fluid end 22 (e.g., at least partially within discharge chamber 53 and/or pump chamber 28) in concentric bore pump fluid end 22 designs such as FIG. 3, such that a discharge valve body (e.g., poppet) of the discharge valve assembly 72 moves toward the discharge chamber 53 when the discharge valve assembly 72 approaches an open configuration and away from the discharge chamber 53 when the discharge valve assembly 72 approaches a closed configuration. In addition, the discharge valve assembly 72 may be co-axially aligned with the suction valve assembly 56 (e.g., along central axis 17 in concentric bore pump fluid end 22 configurations such as FIG. 3 or along central axis 27 of bore 25 perpendicular to central axis 17 in cross-bore pump fluid end 22 configurations such as FIG. 2A and FIG. 2B). In concentric bore pump fluid end 22 configurations such as FIG. 3, the suction valve assembly 56 and the discharge valve assembly 72 may be coaxially aligned with the reciprocating element 18 (e.g., along central axis 17).

Further, the suction valve assembly 56 and the discharge valve assembly 72 can comprise any suitable mechanism for opening and closing valves. For example, the suction valve assembly 56 and the discharge valve assembly 72 can comprise a suction valve spring and a discharge valve spring, respectively. Additionally, any suitable structure (e.g., valve assembly comprising sealing rings, stems, valve guides, poppets, etc.) and/or components may be employed for retaining the components of the suction valve assembly 56 and the components of the discharge valve assembly 72 within the pump fluid end 22. For example, the discharge valve assembly 72 and/or the suction valve assembly 56 can comprise a valve poppet, as described, for example, in U.S. patent application Ser. No. 16/436,356 filed Jun. 10, 2019 and entitled "Multi-Material Frac Valve Poppet", the disclosure of which is hereby incorporated herein in its entirety for purposes not contrary to this disclosure. The suction valve assembly 56 can comprise a suction valve seat and a suction valve body, and/or the discharge valve assembly 72 can comprise a discharge valve seat and a discharge valve body. The suction valve body and the discharge valve body can be any known valve bodies, for example, movable valve poppets, and can be wing guided and/or stem guided, or a combination thereof.

The fluid inlet 38 may be arranged within any suitable portion of the pump fluid end 22 and configured to supply fluid to the pump in any direction and/or angle. Moreover, the pump fluid end 22 may comprise and/or be coupled to any suitable conduit (e.g., pipe, tubing, or the like) through which a fluid source may supply fluid to the fluid inlet 38. The pump 10 may comprise and/or be coupled to any suitable fluid source for supplying fluid to the pump via the fluid inlet 38. In embodiments, the pump 10 may also comprise and/or be coupled to a pressure source such as a boost pump (e.g., a suction boost pump) fluidly connected to the pump 10 (e.g., via inlet 38) and operable to increase or "boost" the pressure of fluid introduced to pump 10 via fluid inlet 38. A boost pump may comprise any suitable type including, but not limited to, a centrifugal pump, a gear pump, a screw pump, a roller pump, a scroll pump, a piston/plunger pump, or any combination thereof. For instance, the pump 10 may comprise and/or be coupled to a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi, providing fluid to the suction side of pump 10 at about said pressures. Additionally or alternatively, the boost pump may have a flow rate of greater than or equal to about 80 BPM, about 70 BPM, and/or about 50 BPM.

As noted hereinabove, the pump 10 may be implemented as a multi-cylinder pump comprising multiple cylindrical reciprocating element bores 24 and corresponding components. In embodiments, the pump 10 is a Triplex pump in which the pump fluid end 22 comprises three reciprocating assemblies, each reciprocating assembly comprising a suction valve assembly 56, a discharge valve assembly 72, a pump chamber 28, a fluid inlet 38, a discharge outlet 54, and a reciprocating element bore 24 within which a corresponding reciprocating element 18 reciprocates during operation of the pump 10 via connection therewith to a (e.g., common) pump power end 12. In embodiments, the pump 10 is a Quintuplex pump in which the pump fluid end 22 comprises five reciprocating assemblies. In a non-limiting example, the pump 10 may be a Q-10™ Quintuplex Pump or an HT-400™ Triplex Pump, produced by Halliburton Energy Services, Inc.

In embodiments, the pump fluid end 22 may comprise an external manifold (e.g., a suction header) for feeding fluid to the multiple reciprocating assemblies via any suitable inlet (s). Additionally or alternatively, the pump fluid end 22 may comprise separate conduits such as hoses fluidly connected to separate inlets for inputting fluid to each reciprocating assembly. Of course, numerous other variations may be similarly employed, and therefore, fall within the scope of the present disclosure.

Those skilled in the art will understand that the reciprocating elements of each of the reciprocating assemblies may be operatively connected to the pump power end 12 of the pump 10 according to any suitable manner. For instance, separate connectors (e.g., cranks arms/connecting rods 20, one or more additional components or mechanical linkages 48, pushrods 9, etc.) associated with the pump power end 12 may be coupled to each reciprocating element body or tail end 62. The pump 10 may employ a common crankshaft (e.g., crankshaft 16) or separate crankshafts to drive the multiple reciprocating elements.

As previously discussed, the fluid inlet(s) 38 may receive a supply of fluid from any suitable fluid source, which may be configured to provide a constant fluid supply. Additionally or alternatively, the pressure of supplied fluid may be increased by adding pressure (e.g., boost pressure) as described previously. In embodiments, the fluid inlet(s) 38 receive a supply of pressurized fluid comprising a pressure ranging from about 30 psi to about 300 psi.

Additionally or alternatively, the one or more discharge outlet(s) 54 may be fluidly connected to a common collection point such as a sump or distribution manifold, which may be configured to collect fluids flowing out of the fluid outlet(s) 54, or another cylinder bank and/or one or more additional pumps.

During pumping, the multiple reciprocating elements 18 will perform forward and returns strokes similarly, as described hereinabove. In embodiments, the multiple reciprocating elements 18 can be angularly offset to ensure that no two reciprocating elements are located at the same position along their respective stroke paths (i.e., the plungers are "out of phase"). For example, the reciprocating elements may be angularly distributed to have a certain offset (e.g., 120 degrees of separation in a Triplex pump) to minimize undesirable effects that may result from multiple reciprocating elements of a single pump simultaneously producing pressure pulses. The position of a reciprocating element is generally based on the number of degrees a pump crankshaft (e.g., crankshaft 16) has rotated from a bottom dead center (BDC) position. The BDC position corresponds to the position of a fully retracted reciprocating element at zero velocity, e.g., just prior to a reciprocating element moving (i.e., in a direction indicated by arrow 117 in FIGS. 2A-2B and FIG. 3) forward in its cylinder. A top dead center position corresponds to the position of a fully extended reciprocating element at zero velocity, e.g., just prior to a reciprocating element moving backward (i.e., in a direction indicated by arrow 116 in FIGS. 2A-2B and FIG. 3) in its cylinder.

As described above, each reciprocating element 18 is operable to draw in fluid during a suction (backward or return) stroke and discharge fluid during a discharge (forward) stroke. Skilled artisans will understand that the multiple reciprocating elements 18 may be angularly offset or phase-shifted to improve fluid intake for each reciprocating element 18. For instance, a phase degree offset (at 360 degrees divided by the number of reciprocating elements) may be employed to ensure the multiple reciprocating elements 18 receive fluid and/or a certain quantity of fluid at all times of operation. In one implementation, the three reciprocating elements 18 of a Triplex pump may be phase-shifted by a 120-degree offset. Accordingly, when one reciprocating element 18 is at its maximum forward stroke position, a second reciprocating element 18 will be 60 degrees through its discharge stroke from BDC, and a third reciprocating element will be 120 degrees through its suction stroke from top dead center (TDC).

Herein disclosed is a discharge valve assembly 72 configured to control fluid flow out of a chamber 28 of a pump fluid end 22 of a pump 10. The discharge valve assembly 72 of this disclosure comprises a controllable holding system (CHS) 90 that is controllable to hold the discharge valve assembly 72 in an open configuration (e.g., a discharge valve assembly 72 configuration which allows fluid flow through the discharge valve assembly 72). As described further hereinbelow, the CHS 90 can be electromagnetically, hydraulically, and/or mechanically actuatable. The CHS 90 can comprise a discharge valve arrestor 81, as described hereinbelow.

A discharge valve assembly of this disclosure can be a poppet-type valve assembly or a rotary-type valve assembly. A poppet style valve assembly comprises a poppet (also referred to herein as a "valve") that moves away from and toward a valve seat to assume an open configuration and a closed configuration, respectively, of the poppet style valve assembly. A rotary type valve assembly comprises a valve body that rotates within a valve seat to assume an open configuration and a closed configuration, respectively, of the rotary valve assembly. Although described with reference to FIGS. 5-7 depicting a poppet style discharge valve assembly, it is to be understood that the discharge valve assembly 72 of this disclosure can comprise another type of valve assembly, and such other types of valve assemblies are within the scope of this disclosure.

Via this disclosure, a pump disabler comprises a CHS 90 that can capture a movable component of the discharge valve assembly (e.g., a discharge valve poppet) and stop it from returning to the discharge valve seat. When the CHS 90 is activated, pulsating pressures can arise due to reciprocation of the reciprocating element 18 moving back and forth in the reciprocating element bore 24. As described hereinbelow, these pulsating pressures can be programmed to send a pulse in every stroke of the pump 10, or can be programmed, e.g., every fifth stroke, to create a desired pulse. As detailed further hereinbelow, the creation of pulsating flow rates of the discharged fluid (e.g., the fluid discharged via discharge outlet(s) 54 of pump 10) enabled by the CHS 90 of this disclosure can be utilized, for example, to improve fracture development. In embodiments, the CHS 90 can be activated or energized prior to positioning movable component (e.g., the poppet) of the discharge valve assembly 72 adjacent or within the valve arrestor thereof.

A discharge valve assembly 72 of this disclosure will now be described with reference to FIG. 5, which is a schematic cross section view of a discharge valve assembly 72, according to embodiments of this disclosure. Discharge valve assembly 72 of FIG. 5 comprises an electromagnetically actuatable CHS 90A. As detailed hereinbelow, electromagnetically actuatable CHS 90A comprises a valve arrestor 81, an electromagnet 97, and electrical wire(s) 95.

As utilized with reference to components of discharge valve assembly 72 of FIG. 5, FIG. 6A, and FIG. 6B, "left side" indicates to the left of the valve seat 72C in the drawing, while "right side" refers to the right side of valve seat 72C in the drawing, and does not indicate left or right with respect to a pump fluid end 22 comprising the discharge valve assembly 72 or a pump comprising such a pump fluid end 22.

In the embodiment of FIG. 5, the discharge valve assembly 72 is a poppet style valve assembly comprising poppet 79 that moves away from a discharge valve seat 72C in a direction indicated by arrow A1 to open the discharge valve assembly 72 and toward discharge valve seat 72C in a direction indicated by arrow A2 to close valve assembly 72. Poppet 79 comprises discharge valve body 72A, discharge valve insert 72B, left side valve stem 103A, and right side valve stem 103B. Although depicted in the embodiment of FIG. 5 as a single component, a poppet 79 of this assembly can comprise multiple components, rather than being a single unitary piece. For example, two, three, or more of the components of a poppet 79 of this disclosure selected from a discharge valve insert 72B, a poppet insert retainer, a poppet seat, a left side valve stem 103A, and/or a right side valve stem 103B can be disparate components. For example, in embodiments, valve body 72A comprises a valve body insert retainer and a poppet seat. Such a multi-component poppet 79 is described, for example, in U.S. patent application Ser. No. 16/436,356, entitled Multi Material Frac Valve Poppet, filed Jun. 10, 2019, the disclosure of which is hereby incorporated herein for purposes not contrary to this disclosure.

Discharge valve seat 72C is disposed within the pump fluid end body 8, such that, in operation, poppet 79 moves away from and toward discharge valve seat 72C, thus respectively opening and closing the discharge valve assembly 72 by removing contact of (e.g., valve body 72A of) poppet 79 with discharge valve seat 72C and providing contact of (e.g., valve body 72A of) poppet 79 with discharge valve seat 72C, respectively. The discharge valve assembly 72 comprises a biasing member, which, in the discharge valve assembly 72 of FIG. 5 comprises discharge valve spring 31.

Left side valve guide 73 and right side valve guide 74 of discharge valve assembly 72 maintain alignment of valve stem 103 comprising left side valve stem 103A and right side valve stem 103B within the pump fluid end 22. For example, left side valve guide 73 can help maintain alignment of left side valve stem 103A within the pump fluid end 22, while right side valve guide 74 can help maintain alignment of right side valve stem 103B within the pump fluid end 22. As noted above, discharge valve body 72A can be integrated as a single component with left side valve stem 103A and/or right side valve stem 103B. In such embodiments, valve stem 103 comprises left side 103A and right side 103B of the unitary valve stem 103, and left side valve guide 73 can help maintain alignment of the left side 103A of the valve stem 103 within the pump fluid end 22, while right side valve guide 74 can help maintain alignment of the right side 103B of the valve stem 103 within the pump fluid end 22.

As depicted in FIG. 6A, which is a schematic front view of a left side valve guide 73, according to embodiments of this disclosure, left side valve guide 73 can comprise a left side valve guide outer ring 73A and a left side valve guide inner ring 73B, connected by one or more left side valve guide connectors 73C. Left side valve guide 73 provides a left side valve guide bore 73D, through which left side valve stem 103A (or left side 103A of unitary valve stem 103) can pass during opening and closing of the discharge valve assembly 72. Similarly, as depicted in FIG. 6B, which is a schematic front view of a right side valve guide 74, according to embodiments of this disclosure, right side valve guide 74 can comprise a right side valve guide outer ring 74A and a right side valve guide inner ring 74B, connected by one or more right side valve guide connectors 74C. Right side valve guide 74 provides a right side valve guide bore 74D, through which right side valve stem 103B (or left side 103B of unitary valve stem 103) can pass during opening and closing of the discharge valve assembly 72. Discharge valve insert 72B can be an elastomeric insert, as known in the art. Other designs, shapes, and sections or components of poppet 79 (e.g., of discharge valve body 72A, discharge valve insert 72B, left side valve guide 73, and right side valve guide 74) are possible, and such other poppets 79 and valve guides 73/74 are within the scope of this disclosure.

As depicted in FIG. 6C, which is a schematic front view of a valve arrestor 81, according to embodiments of this disclosure, valve arrestor 81 can comprise a valve arrestor outer ring 81A and a valve arrestor inner ring 81B, connected by one or more valve arrestor connectors, and provides a valve arrestor bore 81D, through which an end E1 of right side valve stem 103B (or an end E1 of the right side 103B of unitary valve stem 103) can pass during opening and closing of discharge valve assembly 72. Other designs, shapes, and components of valve arrestor 81 are possible, and such other valve arrestors 81 are within the scope of this disclosure. In embodiments of discharge valve assembly 72 comprising an electromagnetically actuatable CHD 90A, such as depicted in FIG. 5, valve arrestor 81 can be configured for positioning therein of electromagnet 97 and electrical wires 98, as described further hereinbelow.

As noted hereinabove, an electromagnetically actuatable CHS 90A can comprise a discharge valve arrestor 81, an electromagnet 97, and electrical wire(s) 98. Electromagnet 97 is positioned within valve arrestor 81, proximate the valve arrestor bore 81D of discharge valve arrestor 81. CHS 90A is operable as an electromagnetic locking system, whereby actuation of electromagnet 97 via the passage of electricity through electrical wires 98 magnetically attracts right side valve stem 103B when movement of poppet 79 in the direction of arrow A1 away from discharge valve seat 72C positions right side valve stem 103B within valve arrestor bore 81D. The magnetic attraction between electromagnet 97 and right side valve stem 103B results in locking of the right side valve stem 103B within valve arrestor 81, thus preventing closing of the discharge valve assembly 72 (i.e., preventing movement of poppet 79 back in the direction of arrow A2 toward discharge valve seat 72C).

The electromagnetically actuatable CHS 90A can be activated or energized prior to positioning of the poppet 79 (e.g., a portion of right side valve stem 103B of poppet 79) adjacent to or within valve arrestor bore 81D.

Figure 7B:
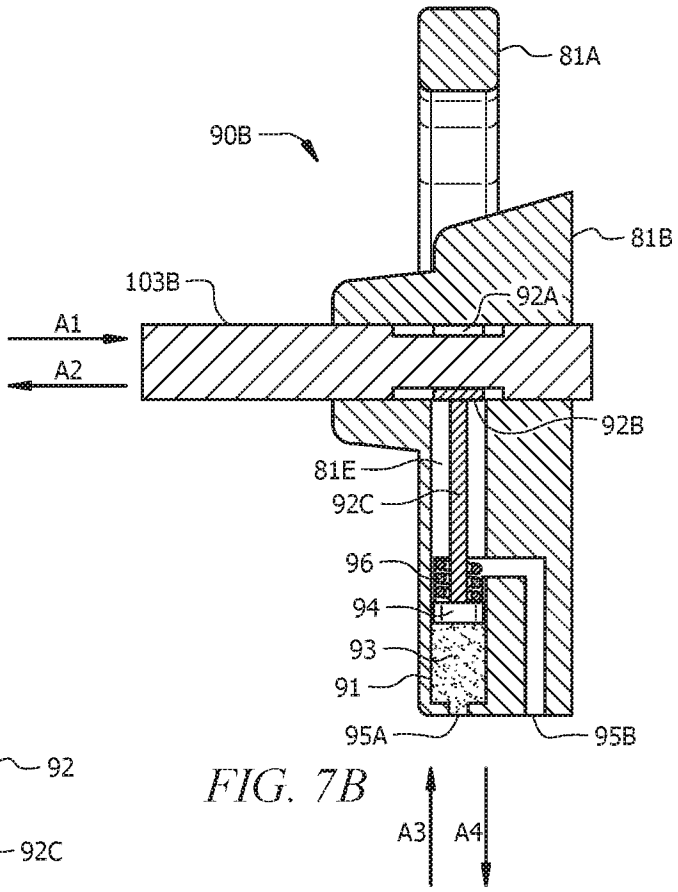
FIG. 7B is a schematic cross section view of the hydraulically actuatable controllable holding system of FIG. 7A in an engaged configuration in which the controllable holding system is holding the discharge valve assembly in the open configuration.
Figure 7C:
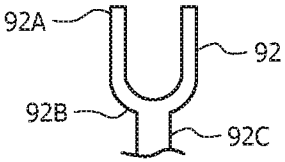
FIG. 7C is a front view of the fork of the hydraulically actuatable controllable holding system of FIG. 7A and FIG. 7B.
Figure 7A:
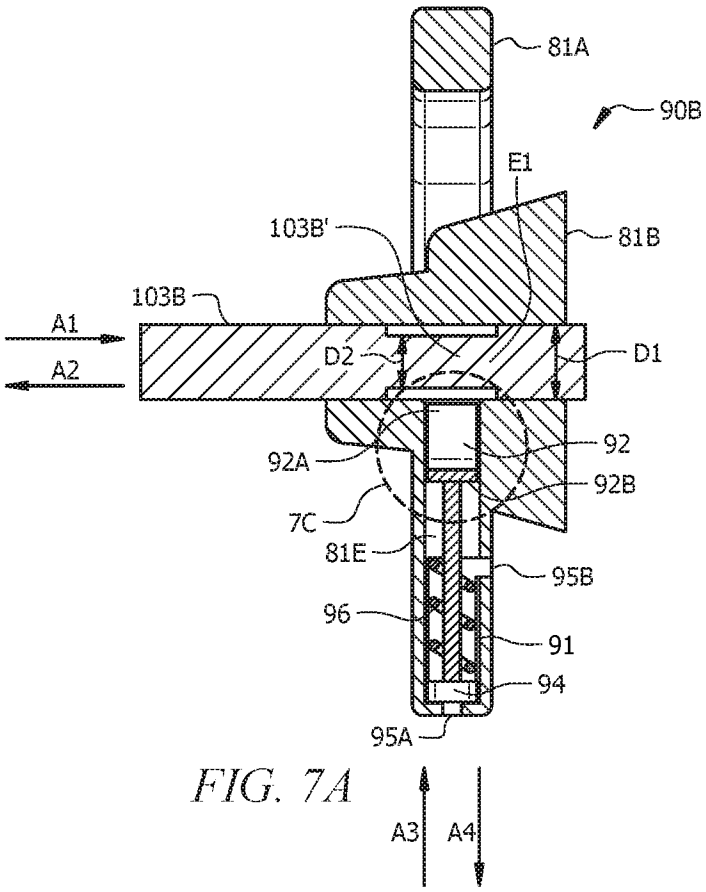
FIG. 7A is a schematic cross section view of a hydraulically actuatable controllable holding system, in a disengaged configuration in which the controllable holding system is not holding the discharge valve assembly in an open configuration, according to embodiments of this disclosure.

In alternative embodiments, the CHS 90 comprises a hydraulically actuatable CHS 90B. A discharge valve assembly 72 of this disclosure comprising such a hydraulically actuatable CHS 90B will now be described with reference to FIG. 7A, which is a schematic cross section view of a hydraulically actuatable CHS 90B, according to embodiments of this disclosure. In FIG. 7A, the CHS 90B is depicted in a disengaged configuration in which the CHS 90B is not holding the discharge valve assembly 72 in an open configuration (i.e., in which the right side valve stem 103B/poppet 79 is released from the CHS 90). FIG. 7B is a schematic cross section view of the hydraulically actuatable CHS 90B of FIG. 7A in an engaged configuration in which the CHS 90B is holding the discharge valve assembly 72 in the open configuration (i.e., in which the right side valve stem 103B/poppet 79 is held by the CHS 90B). The discharge valve assembly 72 of FIG. 7A and FIG. 7B comprises a hydraulically actuatable CHS 90B. As detailed hereinbelow, hydraulically actuatable CHS 90B can comprise a valve arrestor 81, a hydraulic cylinder 91, a fork 92, a cylinder fluid 93, a piston 94, a cylinder rod side port 95A, a cylinder piston side port 95B, and a spring 96.

Discharge valve arrestor 81 of FIG. 7A and FIG. 7B can be substantially as described hereinabove with reference to FIG. 6C, but configured for positioning (at least partially) therein of hydraulic cylinder 91 (comprising therein cylinder (e.g., hydraulic or wellbore servicing) fluid 93), fork 92, piston 94, cylinder rod-side port 95A, cylinder piston-side port 95B, and spring 96, as described further hereinbelow. That is, discharge valve arrestor 81 can comprise a valve arrestor outer ring 81A and a valve arrestor inner ring 81B, connected by one or more connectors 81C, and can provide a valve arrestor bore 81D, through which an end E1 of right side valve stem 103B (or an end E1 of the right side 103B of unitary valve stem 103) can pass during opening and closing of discharge valve assembly 72. As noted hereinabove, other designs, shapes, and components of valve arrestor 81 are possible, and such other valve arrestors 81 are within the scope of this disclosure.

In operation, when hydraulically actuatable CHS 90B is not actuated, discharge valve assembly 72 can open as poppet 79 moves in the direction of arrow A1 and discharge valve body 72A is separated from discharge valve seat 72C, thus allowing fluid flow through discharge valve assembly 72 (i.e., between discharge valve body 72A and discharge valve seat 72C) and can close as poppet 79 moves in the direction of arrow A2 and discharge valve body 72A contacts discharge valve seat 72C, thus preventing fluid flow through discharge valve assembly 72 (i.e., between discharge valve body 72A and discharge valve seat 72C). In the embodiment of FIG. 7A and FIG. 7B, right side valve stem 103B comprises a shoulder or undercut section 103B' having a smaller diameter D2 than a diameter D1 of the remainder of right side valve stem 103B. When hydraulically actuatable CHS 90B is actuated, cylinder fluid 93 enters cylinder 91 via cylinder piston-side port 95A, thus pushing piston 94 in the direction indicated by arrow A3. As depicted in FIG. 7C, which is a front view of the fork 92 of the hydraulically actuatable CHS 90B of FIG. 7A and FIG. 7B, piston 94 is connected to fork stem 92C of fork 92. Accordingly, movement of piston 92 in the direction indicated by arrow A3 also moves fork 92 in the direction indicated by arrow A3 along a fork bore 81E of valve arrestor 81. Top 92A of fork 92 engages shoulder or undercut region 103B' of right side valve stem 103B, thus preventing the return of poppet 79 in the direction indicated by arrow A2 and holding the discharge valve assembly 72 in the open configuration. When it is desired to restart operation of the pump chamber 28 comprising the discharge valve assembly 72, fork 92 disengages from right side valve stem 103B by movement of fork 92 in the direction indicated by arrow A4, thus allowing poppet 79 to move in the direction indicated by arrow A2, whereby discharge valve body 72A comes into contact with discharge valve seat 72C, thus closing discharge valve assembly 72. Standard operation of the discharge valve assembly 72 can then continue, with the discharge valve assembly 72 opening and closing during discharge and suction strokes of the reciprocating element 18.

The cylinder fluid 93 utilized to operate the piston 94 of the hydraulically actuatable CHS 90B can comprise a conventional hydraulic fluid. In such embodiments, cylinder piston-side port 95A can be fluidly connected with an external source of hydraulic fluid (e.g., external to a pump 10 comprising the discharge valve assembly 72), and cylinder rod-side port 95B can, as depicted in FIG. 7B, be fluidly connected with a hydraulic fluid outlet that can also be external to the pump 10. Alternatively, the cylinder fluid utilized to operate the piston 94 can comprise a treatment fluid (e.g., a wellbore servicing fluid) being pumped by the pump 10 comprising the discharge valve assembly 72. In such embodiments, cylinder piston-side port 95A can be configured to allow pressurized treatment fluid (e.g., wellbore servicing fluid) to be utilized as the cylinder fluid 93, and cylinder rod-side port 95B can, as depicted in FIG. 7A, be configured to allow the fluid to return the fluid flow path to the lower pressure portion of the pump 10. In such embodiments, a filter can be positioned on cylinder piston-side port 95A to filter particulate material from the treatment fluid prior to introduction thereof into cylinder 91, thus preventing blockage of cylinder 91

The CHS 90 can be externally controllable, such that timing of the actuation thereof can be provided from a source external to the pump 10.

Also disclosed herein is a pump fluid end 22 comprising the discharge valve assembly 72 having the CHS 90 as described hereinabove. The pump fluid end 22 comprises: one or more chambers 28, each of the one or more chambers 28 having a fluid inlet 38 and a discharge outlet 54 and comprising: a reciprocating element 18 at least partially within a reciprocating element bore 24 of the pump fluid end 22, wherein the reciprocating element bore 24 extends into the pump fluid end 22 from a back end S2 of the pump fluid end 22 and has a central axis 17; a suction valve assembly 56 configured to control fluid flow into the chamber 28; and a discharge valve assembly 72 configured to control fluid flow out of the chamber 28, wherein at least one of the one or more chambers 28 comprises the discharge valve assembly 72 comprising a CHS 90 as described hereinabove.

The pump fluid end 22 of this disclosure can be a concentric bore pump fluid end, as described with reference to FIG. 3 hereinabove, or a cross bore pump fluid end, such as a x-bore pump fluid end 22 described hereinabove with reference to FIG. 2A or a tee-bore pump fluid end 22 described hereinabove with reference to FIG. 2B.

Also disclosed herein is a pump 10 comprising a pump fluid end 22 of this disclosure comprising the discharge valve assembly 72 having the CHS 90 as described hereinabove; and a pump power end 12, wherein the pump power end 12 is operable to reciprocate the reciprocating element 18 within the reciprocating element bore 24 of the pump fluid end 22. The pump fluid end 22 of the pump 10 comprises one or more chambers 28, each of the one or more chambers 28 having a fluid inlet 38 and a discharge outlet 54 and comprising: a reciprocating element 18 at least partially within a reciprocating element bore 24 of the pump fluid end 22, wherein the reciprocating element bore 24 extends into the pump fluid end 22 from a back end S2 of the pump fluid end 22 and has a central axis 17; a suction valve assembly 56 configured to control fluid flow into the chamber 28; and a discharge valve assembly 72 configured to control fluid flow out of the chamber 28, wherein at least one of the one or more chambers 28 comprises the discharge valve assembly 72 of this disclosure comprising the CHS 90. As noted above, the pump fluid end 22 can be a concentric bore pump fluid end 22; or a cross-bore pump fluid end 22.

In embodiments, the pump 10 is a multiplex pump comprising a plurality of chambers 28, wherein the plurality comprises N chambers 28, and wherein the at least one of the one or more chambers 28 that comprises the CHS 90 comprises n of the N chambers, wherein n is from 1 to N. In embodiments, n=1, such that a single of the plurality of chambers 28 comprises a CHS 90 of this disclosure. In alternative embodiments, n=N, such that all of the plurality of chambers 28 comprise a CHS 90 of this disclosure.

Figure 8:
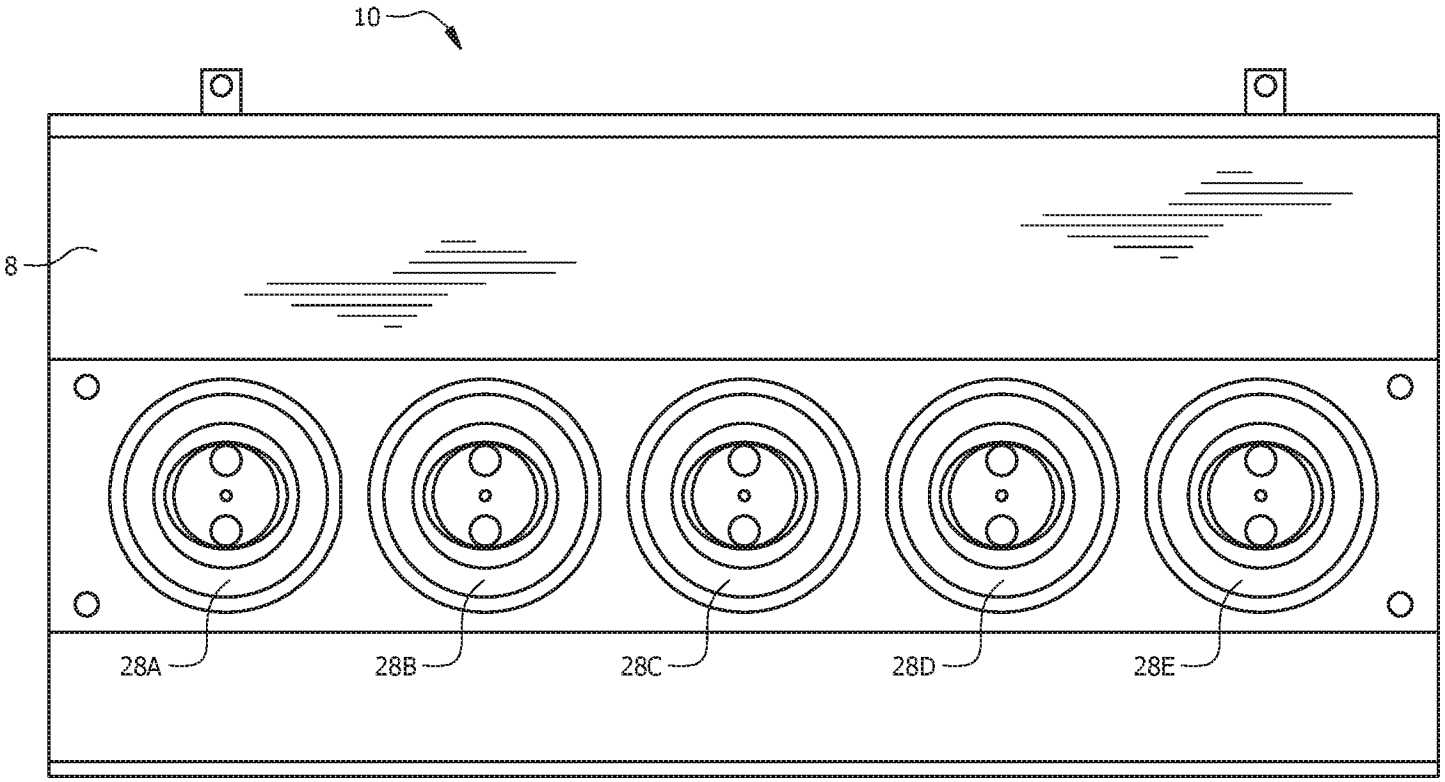
FIG. 8 is a schematic of a pump comprising a pump fluid end of this disclosure.

A pump 10 of this disclosure can be a multiplex pump comprising a plurality (e.g., N) of reciprocating assemblies (e.g., reciprocating elements 18, and a corresponding plurality (e.g., N) of reciprocating element bores 24, suction valve assemblies 56, and discharge valve assemblies 72). The plurality (N) can comprise any number such as, for example, 2, 3, 4, 5, 6, 7, or more. For example, in embodiments, pump 10 is a triplex pump, wherein the plurality comprises three (e.g., N=3). In alternative embodiments, pump 10 comprises a Quintuplex pump, wherein the plurality comprises five (e.g., N=5). For example, FIG. 8 is a schematic of a Quintuplex pump 10 comprising a pump fluid end 22 having five chambers 28 (e.g., first chamber 28A, second chamber 28B, third chamber 28C, fourth chamber 28D, and fifth chamber 28E). According to this disclosure, one or more of the five chambers 28 comprises a discharge valve assembly 28 having a CHS 90 as described herein.

Also disclosed herein is a method of disabling a pump 10 and/or discharging fluid from the pump 10 such that the discharged fluid exhibits a pulsed flow rate. The method comprises: pumping a fluid with a pump 10 of this disclosure, and actuating the CHS 90 of one or more of the at least one of the one or more chambers 28 of the pump fluid end 22 comprising the CHS 90, whereby the discharge valve assembly 72 of the one or more of the at least one of the one or more chambers 28 comprising the CHS 90 is held in the open configuration.

The pump 10 is a pump 10 of this disclosure comprising a pump fluid end 22 and a pump power end 12: wherein the pump fluid end 22 comprises: one or more chambers 28, each of the one or more chambers 28 having a fluid inlet 38 and a discharge outlet 54 and comprising a reciprocating element 18; a suction valve assembly 56 configured to control fluid flow into the chamber 28; and a discharge valve assembly 72 configured to control fluid flow out of the chamber 28, wherein the reciprocating element 18 is at least partially within a reciprocating element bore 24 of the pump fluid end 24, wherein the reciprocating element bore 24 extends into the pump fluid end 22 from a back end S2 of the pump fluid end 22 and has a central axis 17; and wherein at least one of the one or more chambers 28 comprises a CHS 90 of this disclosure, wherein the CHS 90 is controllable to hold the discharge valve assembly 72 in an open configuration; and wherein the pump power end 12 is operable to reciprocate the reciprocating element 18 within the reciprocating element bore 24 of the pump fluid end 22.

In embodiments, each of the one or more chambers 28 comprises a CHS 90 of this disclosure, and the method comprises disabling the pump 10 by actuating the CHS 90 of each of the one or more chambers 28, whereby the discharge valve assemblies 72 of each of the one or more chambers 28 are held in the open configuration such that the pump 10 is disabled.

Figure 9:
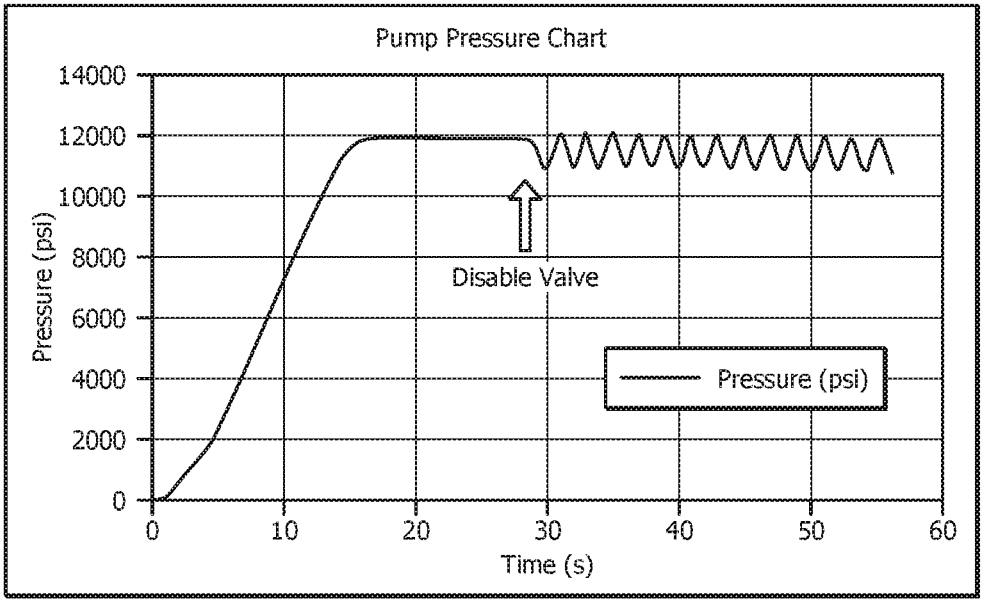
FIG. 9 is a pump pressure chart showing the pressure (psi) as a function of time (s) for an exemplary single chamber pump of this disclosure.

In embodiments, the actuating the CHS 90 of one or more of the at least one of the one or more chambers 28 comprising the CHS 90 results in at least one of the one or more chambers 28 of the pump fluid end 22 having a discharge valve assembly 72 that is not held in the open configuration, such that the fluid discharged from the pump 10 via the fluid outlet(s) 54 (e.g., the discharged fluid) exhibits a pulsed flow rate. The movement of the reciprocating element(s) 18 can thus cause a pressure fluctuation which can be utilized to help fracture initiations and extensions. For example, as depicted in FIG. 9, which is a pump pressure chart showing the pressure (psi) as a function of time (s) for an exemplary single chamber 28 pump 10 of this disclosure, upon disabling of the discharge valve assembly 72, a pulsating pressure can be produced by the discharged fluid.

Figure 10:
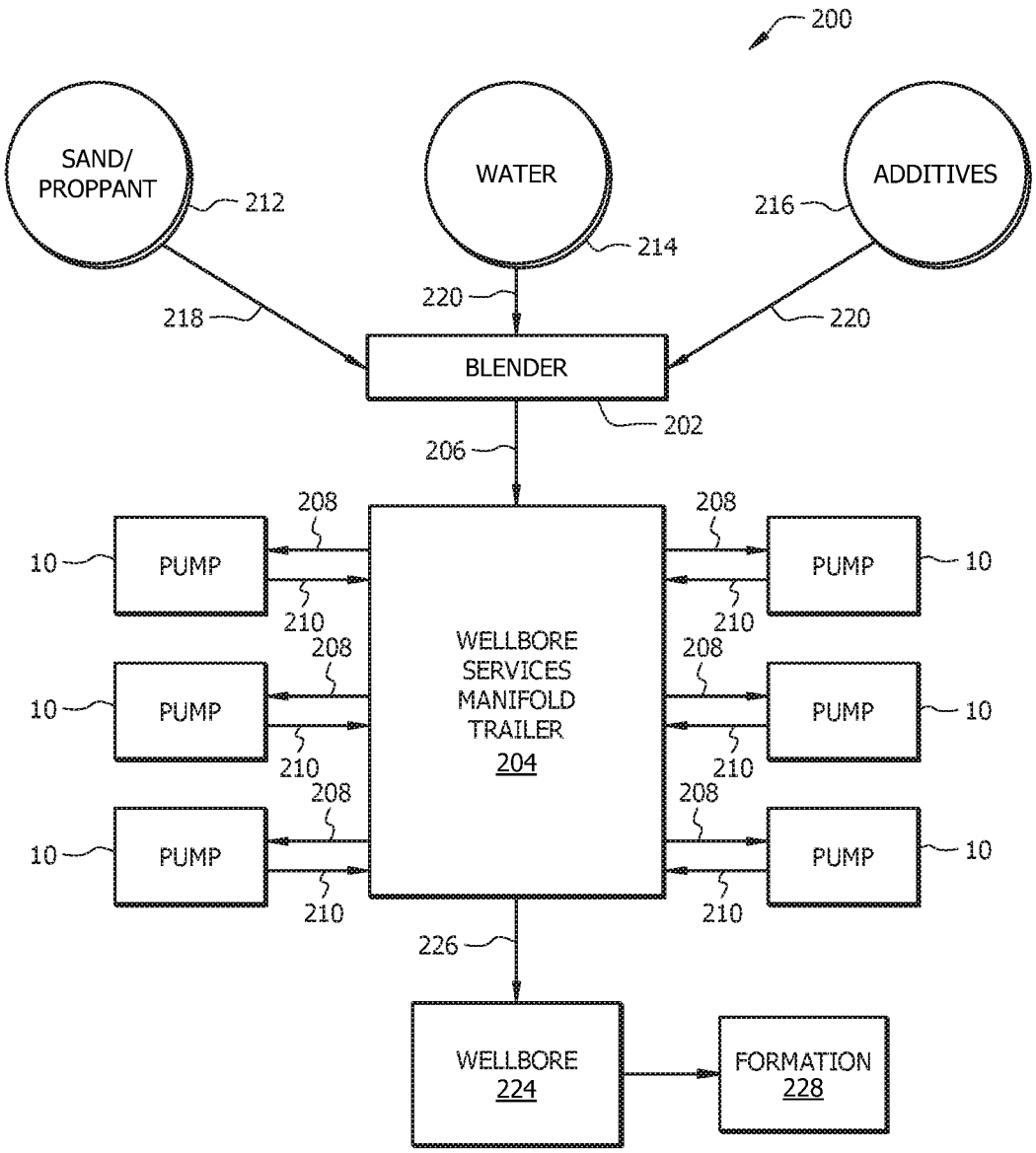
FIG. 10 is a schematic representation of an embodiment of a wellbore servicing system, according to embodiments of this disclosure.

Also disclosed herein are a method of servicing a wellbore and a wellbore servicing system 200 comprising a pump of this disclosure. An embodiment of a wellbore servicing system 200 and a method of servicing a wellbore via the wellbore servicing system 200 will now be described with reference to FIG. 10, which is a schematic representation of an embodiment of a wellbore servicing system 200, according to embodiments of this disclosure.

A method of servicing a wellbore 224 according to this disclosure comprises: fluidly coupling a pump 10 of this disclosure to a source of a wellbore servicing fluid and to the wellbore 224; and communicating wellbore servicing fluid into a formation 228 in fluid communication with the wellbore 224 via the pump 10, wherein the pump comprises a pump fluid end 22 and a pump power end 12, wherein the pump fluid end 22 comprises: one or more chambers 28, each of the one or more chambers 28 having a fluid inlet 38 and a discharge outlet 54 and comprising a reciprocating element 18; a suction valve assembly 56 configured to control fluid flow into the chamber 28; and a discharge valve assembly 72 configured to control fluid flow out of the chamber 28, wherein the reciprocating element 18 is at least partially within a reciprocating element bore 24 of the pump fluid end 22, wherein the reciprocating element bore 24 extends into the pump fluid end 22 from a back end S2 of the pump fluid end 22 and has a central axis 17; and wherein at least one of the one or more chambers 28 comprises a CHS 90 of this disclosure, wherein the CHS 90 is controllable to hold the discharge valve assembly 72 in an open configuration; and wherein the pump power end 12 is operable to reciprocate the reciprocating element 18 within the reciprocating element bore 24 of the pump fluid end 22.

The method of servicing the wellbore can further comprise: disabling the pump 10 and/or discharging fluid from the pump 10 such that the discharged fluid (e.g., the fluid discharged via the discharge outlet(s) 54) exhibits a pulsed flow rate by actuating the CHS 90 of one or more of the at least one of the one or more chambers 28 comprising the CHS 90, whereby the discharge valve assembly 72 of the one or more of the at least one of the one or more chambers 28 comprising the CHS 90 is held in the open configuration.

In embodiments, each of the one or more chambers 28 comprises a CHS 90 of this disclosure, and the method comprises disabling the pump 10 by actuating the CHS 90 of each of the one or more chambers 28, whereby the discharge valve assemblies 72 of each of the one or more chambers 28 are held in the open configuration such that the pump 10 is disabled.

In embodiments, the actuating of the CHS 90 of one or more of the at least one of the one or more chambers 28 comprising the CHS 90 results in at least one of the one or more chambers 28 of the pump fluid end 22 having a discharge valve assembly 72 that is not held in the open configuration, such that the discharged fluid exhibits a pulsed flow rate. The pulsed flow rate can be controlled to match a resonant frequency of the formation 228.

In embodiments, the method of servicing the wellbore comprises fluidly coupling a plurality of pumps 10 to the wellbore 224, communicating the wellbore servicing fluid into the formation 228 via a combined discharge of the plurality of pumps 10, discharging fluid from one or more of the plurality of pumps 10 such that the combined discharged fluid exhibits a pulsed flow rate by actuating the CHS 90 of one or more of the at least one of the one or more chambers 28 comprising the CHS 90 of the one or more of the plurality of pumps 10, whereby the discharge valve assembly 72 of the one or more of the at least one of the one or more chambers 28 comprising the CHS 90 of the one or more of the plurality of pumps 10 is held in the open configuration.

The pumping of the plurality of pumps 10 can be controlled such that the combined discharged fluid has a desired pressure modulation. In this manner, for example, a desired pressure modulation of the discharged fluid can be utilized to enhance fracturing of a formation 228. For example, the pressure modulation can be controlled to match a frequency modulation of the formation 228.

It will be appreciated that the wellbore servicing system 200 disclosed herein can be used for any purpose. In embodiments, the wellbore servicing system 200 may be used to service a wellbore 224 that penetrates a subterranean formation by pumping a wellbore servicing fluid into the wellbore and/or subterranean formation. As used herein, a "wellbore servicing fluid" or "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids suitable for use as the wellbore servicing fluid, the another wellbore servicing fluid, or both include, but are not limited to, cementitious fluids (e.g., cement slurries), drilling fluids or muds, spacer fluids, fracturing fluids or completion fluids, and gravel pack fluids, remedial fluids, perforating fluids, diverter fluids, sealants, drilling fluids, completion fluids, gelation fluids, polymeric fluids, aqueous fluids, oleaginous fluids, etc.

In embodiments, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation.

In embodiments, the wellbore servicing system 200 may be a system such as a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10 that may be mounted to a trailer and transported to the wellsite via a semi-tractor) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In embodiments, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In embodiments, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In embodiments, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available preblender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In embodiments, the pump(s) 10 (e.g., pump(s) 10 and/or maintained pump(s) 10) pressurize the wellbore servicing fluid to a pressure suitable for delivery into a wellbore 224 or wellhead. For example, the pumps 10 may increase the pressure of the wellbore servicing fluid (e.g., the wellbore servicing fluid and/or the another wellbore servicing fluid) to a pressure of greater than or equal to about 3,000 psi, 5,000 psi, 10,000 psi, 20,000 psi, 30,000 psi, 40,000 psi, or 50,000 psi, or higher.

From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. In embodiments, each of one or more pumps 10 discharge wellbore servicing fluid at a fluid flow rate of between about 1 BPM to about 200 BPM, alternatively from between about 50 BPM to about 150 BPM, alternatively about 100 BPM. In embodiments, each of one or more pumps 10 discharge wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore 224 (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In other embodiments, the wellbore servicing systems and methods may be employed in well completion operations such as primary and secondary cementing operation to isolate the subterranean formation from a different portion of the wellbore.

In embodiments, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In embodiments, a motor or other power source for a pump may be situated on a common structural support.

In embodiments, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared on-site (e.g., via the operation of one or more blenders) or, alternatively, transported to the site of the servicing operation.

In embodiments, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In alternative embodiments, the reciprocating apparatus may comprise a compressor. In embodiments, a compressor similar to the pump 10 may comprise at least one each of a cylinder, plunger, connecting rod, crankshaft, and housing, and may be coupled to a motor. In embodiments, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In embodiments, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element 18 such as a plunger may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

Those of ordinary skill in the art will readily appreciate various benefits that may be realized by the present disclosure. The herein disclosed CHD 90 provides a way to disable a pump 10, or a section of a pump 10, using the discharge valve assembly 72. Such a design can be particularly useful for pumps 10 comprising a concentric pump fluid end 22, for which placement of a disabler mechanism at the suction side may not be possible.

The discharge valve assembly 72 of this disclosure comprising the CHS 90 can provide for pumping cessation on demand, and/or can provide for the production of desired pulsating pressures at different frequencies for production improvement.

The CHS 90 provides a powerful locking device that can be used to withstand the spring 31 force plus the cyclic forces created by the reciprocating fluid flow. When the CHS 90 is not actuated (e.g., fork 92 is retracted, electromagnet 97 is not energized), the poppet 79 can move freely back and forth along central axis 17A in the directions indicated by arrow A1 and A2, as a conventional discharge valve. When it is desired to disable the pump 10, CHS 90 is actuated, suction valve assembly 56 holds the discharge pressure, and fluid within pump chamber 28 will flow back and forth into the flow lines. The net flow of the pump 10 can therefore be stopped. The ability to disable a pump 10 as described herein can make the pump 10 suitable for electric drive systems, such that the pump 10 can be disabled when motor inertial energy cannot be mechanically decoupled from the pump 10.

Because the fluid flow can continue reciprocating after CHS 90 is actuated, not only can the pump 10 of this disclosure have a net-flow stopping system provided by the discharge valve assembly 72 comprising the CHS 90, the pump 10 can also be operated, as described hereinabove, to generate a (e.g., medium high frequency) pressure fluctuation (e.g., a cyclic pressure fluctuation) that can be utilized, for example, to ease fracture creation and extension.

ADDITIONAL DISCLOSURE

The following are non-limiting, specific embodiments in accordance with the present disclosure:

In a first embodiment, a discharge valve assembly configured to control fluid flow out of a chamber of a pump fluid end of a pump comprises a controllable holding system (CHS), wherein the CHS is controllable to hold the discharge valve assembly in an open configuration.

A second embodiment can include the discharge valve assembly of the first embodiment, wherein the discharge valve assembly is a poppet-type valve assembly or a rotary-type valve assembly.

A third embodiment can include the discharge valve assembly of the first embodiment or the second embodiment, wherein the CHS is electromagnetically, hydraulically, and/or mechanically actuatable.

A fourth embodiment can include the discharge valve assembly of the third embodiment, wherein the CHS is electromagnetically actuatable.

A fifth embodiment can include the discharge valve assembly of the third embodiment, wherein the CHS is hydraulically actuatable, and wherein the CHS comprises a valve arrestor, a fork, a hydraulic cylinder, a hydraulic fluid, and a piston.

A sixth embodiment can include the discharge valve assembly of the fifth embodiment, wherein the fork, the hydraulic cylinder, the hydraulic fluid, and the piston are located primarily within the valve arrestor.

A seventh embodiment can include the discharge valve assembly of the fifth embodiment or the sixth embodiment, wherein the hydraulic fluid comprises a hydraulic fluid introduced from external the pump fluid end comprising the discharge valve assembly or a wellbore servicing fluid being pumped by the pump fluid end.

An eighth embodiment can include the discharge valve assembly of any one of the first to seventh embodiments, wherein the CHS is externally controllable.

In a ninth embodiment, a pump fluid end comprises: one or more chambers, each of the one or more chambers having a fluid inlet and a discharge outlet and comprising: a reciprocating element at least partially within a reciprocating element bore of the pump fluid end, wherein the reciprocating element bore extends into the pump fluid end from a back end of the pump fluid end and has a central axis; a suction valve assembly configured to control fluid flow into the chamber; and a discharge valve assembly configured to control fluid flow out of the chamber, wherein at least one of the one or more chambers comprises the discharge valve assembly of any one of the first to the eighth embodiments.

A tenth embodiment can include the pump fluid end of the ninth embodiment, wherein the pump fluid end is a concentric bore pump fluid end or a cross bore pump fluid end.

In an eleventh embodiment, a pump comprises the pump fluid end of the ninth embodiment or the tenth embodiment and a pump power end, wherein the pump power end is operable to reciprocate the reciprocating element within the reciprocating element bore of the pump fluid end.

A twelfth embodiment can include the pump of the eleventh embodiment, wherein the pump is a multiplex pump comprising a plurality of chambers, wherein the plurality comprises N chambers, and wherein the at least one of the one or more chambers that comprises the controllable holding system (CHS) comprises n of the N chambers, wherein n is from 1 to N.

A thirteenth embodiment can include the pump of the twelfth embodiment, wherein n=1, such that a single of the plurality of chambers comprises the CHS, or wherein n=N, such that all of the plurality of chambers comprise the CHS.

In a fourteenth embodiment, a method of disabling a pump and/or discharging fluid from the pump such that the discharged fluid exhibits a pulsed flow rate comprises: pumping a fluid with the pump, wherein the pump comprises a pump fluid end and a pump power end: wherein the pump fluid end comprises: one or more chambers, each of the one or more chambers having a fluid inlet and a discharge outlet and comprising a reciprocating element; a suction valve assembly configured to control fluid flow into the chamber; and a discharge valve assembly configured to control fluid flow out of the chamber, wherein the reciprocating element is at least partially within a reciprocating element bore of the pump fluid end, wherein the reciprocating element bore extends into the pump fluid end from a back end of the pump fluid end and has a central axis; and wherein at least one of the one or more chambers comprises a controllable holding system (CHS), wherein the CHS is controllable to hold the discharge valve assembly in an open configuration; and wherein the pump power end is operable to reciprocate the reciprocating element within the reciprocating element bore of the pump fluid end; and actuating the CHS of one or more of the at least one of the one or more chambers comprising the CHS, whereby the discharge valve assembly of the one or more of the at least one of the one or more chambers comprising the CHS is held in the open configuration.

A fifteenth embodiment can include the method of the fourteenth embodiment, wherein each of the one or more chambers comprises the CHS, and wherein the method comprises disabling the pump by actuating the CHS of each of the one or more chambers, whereby the discharge valve assemblies of each of the one or more chambers are held in the open configuration such that the pump is disabled.

A sixteenth embodiment can include the method of the fourteenth embodiment, wherein the actuating the CHS of one or more of the at least one of the one or more chambers comprising the CHS results in at least one of the one or more chambers of the pump fluid end having a discharge valve assembly that is not held in the open configuration, such that the discharged fluid exhibits a pulsed flow rate.

In a seventeenth embodiment, a method of servicing a wellbore comprises: fluidly coupling a pump to a source of a wellbore servicing fluid and to the wellbore; and communicating wellbore servicing fluid into a formation in fluid communication with the wellbore via the pump, wherein the pump comprises a pump fluid end and a pump power end, wherein the pump fluid end comprises: one or more chambers, each of the one or more chambers having a fluid inlet and a discharge outlet and comprising a reciprocating element; a suction valve assembly configured to control fluid flow into the chamber; and a discharge valve assembly configured to control fluid flow out of the chamber, wherein the reciprocating element is at least partially within a reciprocating element bore of the pump fluid end, wherein the reciprocating element bore extends into the pump fluid end from a back end of the pump fluid end and has a central axis; and wherein at least one of the one or more chambers comprises a controllable holding system (CHS), wherein the CHS is controllable to hold the discharge valve assembly in an open configuration; and wherein the pump power end is operable to reciprocate the reciprocating element within the reciprocating element bore of the pump fluid end.

An eighteenth embodiment can include the method of the seventeenth embodiment further comprising: disabling the pump and/or discharging fluid from the pump such that the discharged fluid exhibits a pulsed flow rate by actuating the CHS of one or more of the at least one of the one or more chambers comprising the CHS, whereby the discharge valve assembly of the one or more of the at least one of the one or more chambers comprising the CHS is held in the open configuration.

A nineteenth embodiment can include the method of the seventeenth embodiment or the eighteenth embodiment, wherein each of the one or more chambers comprises the CHS, and wherein the method comprises disabling the pump by actuating the CHS of each of the one or more chambers, whereby the discharge valve assemblies of each of the one or more chambers are held in the open configuration such that the pump is disabled.

A twentieth embodiment can include the method of the seventeenth embodiment or the eighteenth embodiment, wherein the actuating the CHS of one or more of the at least one of the one or more chambers comprising the CHS results in at least one of the one or more chambers of the pump fluid end having a discharge valve assembly that is not held in the open configuration, such that the discharged fluid exhibits a pulsed flow rate.

A twenty first embodiment can include the method of the twentieth embodiment, wherein the pulsed flow rate matches a resonant frequency of the formation.

A twenty second embodiment can include the method of the twentieth embodiment or the twenty first embodiment, wherein the method comprises fluidly coupling a plurality of pumps to the wellbore, communicating the wellbore servicing fluid into the formation via a combined discharge of the plurality of pumps, discharging fluid from one or more of the plurality of pumps such that the combined discharged fluid exhibits a pulsed flow rate by actuating the CHS of one or more of the at least one of the one or more chambers comprising the CHS of the one or more of the plurality of pumps, whereby the discharge valve assembly of the one or more of the at least one of the one or more chambers comprising the CHS of the one or more of the plurality of pumps is held in the open configuration.

A twenty third embodiment can include the method of the twenty second embodiment further comprising controlling the pumping of the plurality of pumps such that the combined discharged fluid has a desired pressure modulation.

A twenty fourth embodiment can include the method of any one of the seventeenth to twenty third embodiments, wherein the wellbore servicing fluid comprises a fracturing fluid, a cementitious fluid, a remedial fluid, a perforating fluid, a sealant, a drilling fluid, a spacer fluid, a completion fluid, a gravel pack fluid, a diverter fluid, a gelation fluid, a polymeric fluid, an aqueous fluid, an oleaginous fluid, or a combination thereof.

A twenty fifth embodiment can include the method of any one of the seventeenth to twenty fourth embodiments, wherein the pump operates during the pumping of the wellbore servicing fluid at a pressure of greater than or equal to about 3,000 psi, 5,000 psi, 10,000 psi, 20,000 psi, 30,000 psi, 40,000 psi, or 50,000 psi.

A twenty sixth embodiment can include the method of any one of the seventeenth to twenty fifth embodiments, wherein the pump operates during the pumping of the wellbore servicing fluid at a volumetric flow rate of greater than or equal to about 3, 10, or 20 barrels per minute (BPM), or in a range of from about 3 to about 20, from about 10 to about 20, or from about 5 to about 20 BPM.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A discharge valve assembly configured to control fluid flow out of a chamber of a pump fluid end of a pump, wherein the discharge valve assembly comprises a discharge valve seat, a movable component, and a controllable holding system (CHS), wherein the CHS comprises a discharge valve arrestor comprising a valve arrestor outer ring and a valve arrestor inner ring, connected by one or more connectors, and provides a valve arrestor bore through which an end of the movable component of the discharge assembly passes during opening and closing of the discharge valve assembly, and wherein the CHS is controllable to, when actuated, capture the movable component of the discharge valve assembly and prevent it from returning to the discharge valve seat, thus holding the discharge valve assembly in an open configuration.

2. The discharge valve assembly of claim 1, wherein the discharge valve assembly is a poppet valve assembly or a rotary valve assembly.

3. The discharge valve assembly of claim 1, wherein the CHS is at least one of electromagnetically, hydraulically, and mechanically actuatable.

4. The discharge valve assembly of claim 3, wherein the CHS is electromagnetically actuatable.

5. The discharge valve assembly of claim 1, wherein the CHS is externally controllable.

6. The discharge valve assembly of claim 1, wherein the pump is a concentric bore pump fluid end.

7. A discharge valve assembly configured to control fluid flow out of a chamber of a pump fluid end of a pump, wherein the discharge valve assembly comprises a controllable holding system (CHS), wherein the CHS is controllable to hold the discharge valve assembly in an open configuration, wherein the CHS is hydraulically actuatable, and wherein the CHS comprises a valve arrestor, a fork, a hydraulic cylinder, a hydraulic fluid, and a piston.

8. The discharge valve assembly of claim 7, wherein the fork, the hydraulic cylinder, the hydraulic fluid, and the piston are located primarily within the valve arrestor.

9. The discharge valve assembly of claim 7, wherein the hydraulic fluid comprises a hydraulic fluid introduced from external the pump fluid end comprising the discharge valve assembly or a wellbore servicing fluid being pumped by the pump fluid end.

10. The discharge valve assembly of claim 7, wherein the fork is positioned in a fork bore of the valve arrestor and further comprises a top end and a fork stem, wherein the fork stem is connected to the piston, wherein the discharge valve assembly further comprises a movable component, and wherein, when actuated, introduction of the hydraulic fluid into the cylinder moves the piston, thus forcing the top end of the fork into contact with the movable component.

11. A method of disabling a pump and/or discharging fluid from the pump such that the discharged fluid exhibits a pulsed flow rate, the method comprising:

pumping a fluid with the pump, wherein the pump comprises a pump fluid end and a pump power end:

wherein the pump fluid end comprises: one or more chambers, each of the one or more chambers having a fluid inlet and a discharge outlet and comprising a reciprocating element; a suction valve assembly configured to control fluid flow into the chamber; and a discharge valve assembly configured to control fluid flow out of the chamber, wherein the reciprocating element is at least partially within a reciprocating element bore of the pump fluid end, wherein the reciprocating element bore extends into the pump fluid end from a back end of the pump fluid end and has a central axis; and wherein the discharge valve assembly of at least one of the one or more chambers comprises:

a discharge valve seat, a movable component, and a controllable holding system (CHS), wherein the CHS comprises a discharge valve arrestor comprising a valve arrestor outer ring and a valve arrestor inner ring, connected by one or more connectors, and provides a valve arrestor bore through which an end of the movable component of the discharge assembly passes during opening and closing of the discharge valve assembly, and wherein the CHS is controllable to, when actuated, capture the movable component of the discharge valve assembly and prevent it from returning to the discharge valve seat, thus holding the discharge valve assembly in an open configuration; and wherein the pump power end is operable to reciprocate the reciprocating element within the reciprocating element bore of the pump fluid end; and actuating the CHS of one or more of the at least one of the one or more chambers, whereby the discharge valve assembly of the one or more of the at least one of the one or more chambers is held in the open configuration.

12. The method of claim 11, wherein the at least one of the one or more chambers comprises each of the one or more chambers, and wherein the method comprises disabling the pump by actuating the CHS of each of the one or more chambers, whereby the discharge valve assemblies of each of the one or more chambers are held in the open configuration such that the pump is disabled.

13. The method of claim 11, wherein the actuating the CHS of one or more of the at least one of the one or more chambers results in at least one of the one or more chambers of the pump fluid end having a discharge valve assembly that is not held in the open configuration, such that the discharged fluid exhibits a pulsed flow rate.

14. A method of servicing a wellbore, the method comprising:

fluidly coupling a pump to a source of a wellbore servicing fluid and to the wellbore; and communicating wellbore servicing fluid into a formation in fluid communication with the wellbore via the pump, wherein the pump comprises a pump fluid end and a pump power end, wherein the pump fluid end comprises: one or more chambers, each of the one or more chambers having a fluid inlet and a discharge outlet and comprising a reciprocating element; a suction valve assembly configured to control fluid flow into the chamber; and a discharge valve assembly configured to control fluid flow out of the chamber, wherein the reciprocating element is at least partially within a reciprocating element bore of the pump fluid end, wherein the reciprocating element bore extends into the pump fluid end from a back end of the pump fluid end and has a central axis; and wherein the discharge valve assembly of at least one of the one or more chambers comprises:

a discharge valve seat, a movable component, and a controllable holding system (CHS), wherein the CHS comprises a discharge valve arrestor comprising a valve arrestor outer ring and a valve arrestor inner ring, connected by one or more connectors, and provides a valve arrestor bore through which an end of the movable component of the discharge assembly passes during opening and closing of the discharge valve assembly, and wherein the CHS is controllable to, when actuated, capture the movable component of the discharge valve assembly and prevent it from returning to the discharge valve seat, thus holding the discharge valve assembly in an open configuration; and wherein the pump power end is operable to reciprocate the reciprocating element within the reciprocating element bore of the pump fluid end.

15. The method of claim 14 further comprising: disabling the pump and/or discharging fluid from the pump such that the discharged fluid exhibits a pulsed flow rate by actuating the CHS of one or more of the at least one of the one or more chambers, whereby the discharge valve assembly of the one or more of the at least one of the one or more chambers is held in the open configuration.

16. The method of claim 14, wherein the at least one of the one or more chambers comprises each of the one or more chambers, and wherein the method comprises disabling the pump by actuating the CHS of each of the one or more chambers, whereby the discharge valve assemblies of each of the one or more chambers are held in the open configuration such that the pump is disabled.

17. The method of claim 14, wherein the actuating the CHS of one or more of the at least one of the one or more chambers results in at least one of the one or more chambers of the pump fluid end having a discharge valve assembly that is not held in the open configuration, such that the discharged fluid exhibits a pulsed flow rate.

18. The method of claim 17, wherein the pulsed flow rate matches a resonant frequency of the formation.

19. The method of claim 17, wherein the method comprises fluidly coupling a plurality of pumps to the wellbore, communicating the wellbore servicing fluid into the formation via a combined discharge of the plurality of pumps, discharging fluid from one or more of the plurality of pumps such that the combined discharged fluid exhibits a pulsed flow rate by actuating the CHS of one or more of the at least one of the one or more chambers of the one or more of the plurality of pumps, whereby the discharge valve assembly of the one or more of the at least one of the one or more chambers of the one or more of the plurality of pumps is held in the open configuration.

20. The method of claim 19, further comprising controlling the pumping of the plurality of pumps such that the combined discharged fluid has a desired pressure modulation.

* * * * *